US010717289B2

(12) United States Patent
Nakamura et al.

(10) Patent No.: US 10,717,289 B2
(45) Date of Patent: Jul. 21, 2020

(54) PRINTING APPARATUS AND PRINTING METHOD

(71) Applicant: CANON KABUSHIKI KAISHA, Tokyo (JP)

(72) Inventors: Takashi Nakamura, Yokohama (JP); Akitoshi Yamada, Yokohama (JP); Okinori Tsuchiya, Yokohama (JP); Junichi Nakagawa, Tokyo (JP); Kentaro Yano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/803,459

(22) Filed: Nov. 3, 2017

(65) Prior Publication Data

US 2018/0134043 A1 May 17, 2018

(30) Foreign Application Priority Data

Nov. 11, 2016 (JP) ..... 2016-220858

(51) Int. Cl.

| | |
|---|---|
| ***B41J 2/175*** | (2006.01) |
| ***B41J 2/045*** | (2006.01) |
| ***B41J 2/51*** | (2006.01) |
| ***B41J 2/14*** | (2006.01) |
| ***B41J 2/21*** | (2006.01) |
| *B41J 2/02* | (2006.01) |

(52) U.S. Cl.

CPC ..... *B41J 2/17566* (2013.01); *B41J 2/04573* (2013.01); *B41J 2/14088* (2013.01); *B41J 2/17533* (2013.01); *B41J 2/2132* (2013.01); *B41J 2/51* (2013.01); *B41J 2002/022* (2013.01); *B41J 2002/17569* (2013.01); *B41J 2002/17576* (2013.01)

(58) Field of Classification Search

CPC .... B41J 3/543; B41J 2/17566; B41J 2/04573; B41J 2/51; B41J 2/17503; B41J 2/2103

See application file for complete search history.

(56) References Cited

U.S. PATENT DOCUMENTS

| | | | | |
|---|---|---|---|---|
| 6,000,781 | A * | 12/1999 | Akiyama | B41J 3/54 347/37 |
| 2003/0058295 | A1 | 3/2003 | Heiles | |
| 2012/0212525 | A1 * | 8/2012 | Jaumot | B41J 2/17566 347/6 |

FOREIGN PATENT DOCUMENTS

| | | | |
|---|---|---|---|
| CN | 1310669 | A | 8/2001 |
| CN | 101274511 | A | 10/2008 |
| CN | 101351276 | A | 1/2009 |
| JP | 3495972 | B2 | 2/2004 |

* cited by examiner

*Primary Examiner* — Jason S Uhlenhake

(74) *Attorney, Agent, or Firm* — Canon U.S.A., Inc. IP Division

(57) ABSTRACT

The remaining amounts of inks in tanks are obtained, and, based on the obtained results, whether direction for printing an image next is to be inverted with respect to a set direction. This can reduce a difference in ink remaining amount between the tanks corresponding to print heads.

22 Claims, 13 Drawing Sheets

FIG. 11

| | PRINTING DIRECTIONS FOR INKS (Black/Color) | | | |
|---|---|---|---|---|
| Black PRINTING DIRECTION Flg_Bk | NORMAL 0 | NORMAL 0 | OPPOSITE 1 | OPPOSITE 1 |
| Color PRINTING DIRECTION Flg_Col | NORMAL 0 | OPPOSITE 1 | NORMAL 0 | OPPOSITE 1 |
| FINAL PRINTING DIRECTION Flg_Doc | NORMAL 0 | OPPOSITE 1 | OPPOSITE 1 | OPPOSITE 1 |

PRINTING APPARATUS AND PRINTING METHOD

BACKGROUND

Field of the Disclosure

The present disclosure relates to a printing apparatus and a printing method for printing an image on a recording medium.

Description of the Related Art

An ink-jet printer has been widely spread as an apparatus for printing on a recording medium an image such as text and color images transferred from a host computer. An ink-jet technology has been increasingly applied for printers and copy machines, for example. With this, there is an increased need for a high-speed ink-jet printing technology.

In such an ink-jet printer, high speed printing has been achieved mainly by increasing a printing width and a scanning speed for printing by one scan for reducing a printing time necessary for the scan. In addition to the method, Japanese Patent No. 3495972 proposes a printing method which divides and assigns a printing region to each of a plurality of printing units placed in parallel in order to increase the printing speed. The printing apparatus according to Japanese Patent No. 3495972 includes a left side printing unit configured to print a left side of a printing region and a right side printing unit configured to print a right side of the printing region. The printing apparatus includes tanks for inks of colors of CMYK corresponding to the left side printing unit and tanks for inks of colors of CMYK corresponding to the right side printing unit separately from the tanks corresponding to the left side printing unit.

The printing apparatus according to Japanese Patent No. 3495972 is configured such that the right and left printing units can print right side and left side regions, respectively, of a recording medium. When no ink remains in one of the eight ink tanks including four right ink tanks and four left ink tanks, printing cannot be executed however. Furthermore, a user may not always replace the tanks.

SUMMARY

The present disclosure according to one or more aspects can increase the printable amount of each of mounted ink tanks.

A printing apparatus includes a first printing unit having printing elements for ejecting ink stored in a first tank, the first printing unit being configured to perform printing on a first region on a recording medium conveyed in a conveying direction, a second printing unit having printing elements for ejecting ink stored in a second tank, the second printing unit being disposed separately from the first printing unit by a predetermined distance in a scanning direction intersecting with the conveying direction, the second printing unit being configured to perform printing on a second region different from the first region in the scanning direction on the recording medium, an obtaining unit configured to obtain first information regarding a remaining amount of the ink in the first tank and second information regarding a remaining amount of the ink in the second tank, a determining unit configured to determine an direction of an image to be printed on the recording medium based on the first information and the second information, and a control unit configured to control printing to be performed on the image based on a result of the determination performed by the determining unit.

Further features of the present disclosure will become apparent from the following description of exemplary embodiments with reference to the attached drawings.

BRIEF DESCRIPTION OF THE DRAWINGS

FIG. 11 is a table illustrating a method for finally determining a printing direction according to one or more aspects of the present disclosure.

DESCRIPTION OF THE EMBODIMENTS

First Embodiment

With reference to drawings, an embodiment of the present disclosure will be described below.

Figure 1:
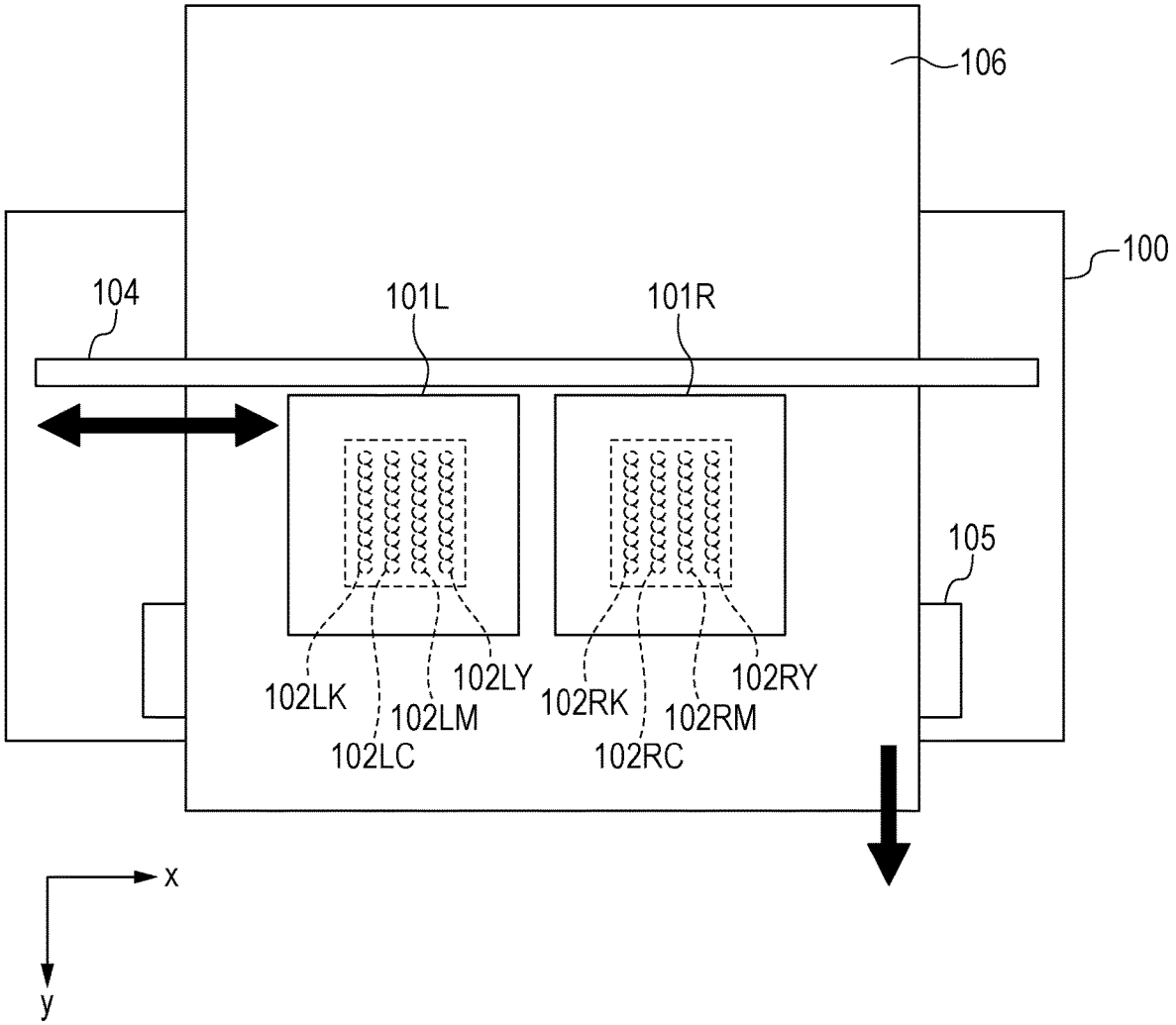
FIG. 1 is a schematic diagram of an ink-jet printer.

FIG. 1 schematically illustrates an ink-jet printer according to one or more aspects of the present disclosure. The ink-jet printer according to this embodiment is a printing apparatus which prints an image on a recording medium by using inks of a plurality of colors as recording agents. Here, a black (K) ink being an achromatic ink and cyan (C), magenta (M), and yellow (Y) inks being chromatic inks are used. Referring to FIG. 1, a printer 100 includes two print heads as printing units on a frame forming a structural member of the printer. FIG. 1 Illustrates a left side print head 101L and a right side print head 101R. The print head 101L has a printing chip, and the printing chip includes printing elements configured to eject ink. The printing elements according to this embodiment are heating elements configured to eject ink heated and foamed by a heating device such as a heater and are provided within nozzles. The printing chip has nozzle arrays each for an ink color including a black nozzle array 102LK, a cyan nozzle array 102LC, a magenta nozzle array 102LM, and a yellow nozzle array 102LY. The print head 101R also has a printing chip having a printing element group configured to eject inks of the same colors as those of inks ejectable from the print head 101L. The print head 101R has nozzle arrays including a black nozzle array 102RK, a cyan nozzle array 102RC, a magenta nozzle array 102RM, and a yellow nozzle array 102RY.

The printer 100 is a so-called serial printer. Each of the print head 101L and the print head 101R has a plurality of nozzles arranged in a direction (Y direction in FIG. 1) intersecting by 90 degrees with a width direction (X direction in FIG. 1) of a recording sheet 106 being a recording medium. These print heads may be reciprocally scanned in the X direction (scanning direction) along a guide 104 to print an image on the recording sheet 106. The nozzle arrangement of the nozzle arrays has a resolution of 1200 dpi (dot per inch). In other words, nozzles are arranged at intervals of 1/1200 inches in the Y direction.

The recording sheet 106 is conveyed in the Y direction (conveying direction). The recording sheet 106 is conveyed by a conveying roller 105 (and other rollers, not illustrated) rotated by driving force of a motor (not illustrated). When the recording sheet 106 is fed, inks are ejected from the nozzles of the print head 101L and the print head 101R based on print data so that an image can be printed which has a width for one scan corresponding to the length of the nozzle arrays in the Y direction. After printing by one scan completes, the recording sheet 106 is conveyed by the width corresponding to the length of the nozzle arrays again so that the image of the width for one scan performed by the print heads is printed. The conveyance of a recording medium and the operation for discharging inks from the print heads are repeatedly performed to print an image on the recording medium.

Figure 2:
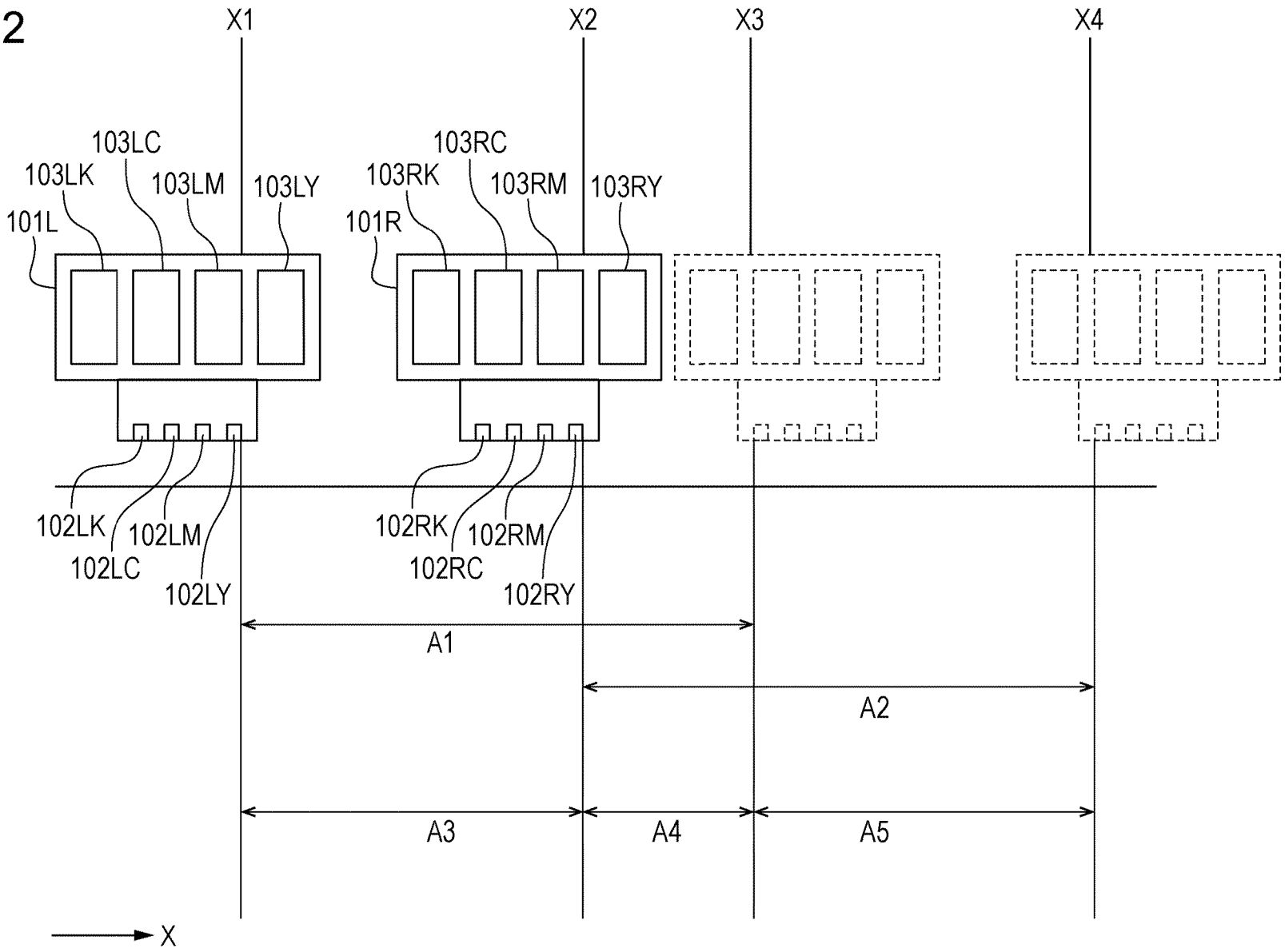
FIG. 2 is a schematic diagram of a printer having two print heads according to one or more aspects of the present disclosure.

FIG. 2 illustrates how the printer 100 illustrated in FIG. 1 uses the print head 101L and the print head 101R to form an image on the recording sheet 106. Because the print head 101L and the nozzle arrays 102LK, 102LC, 102LM, and 102LY and the print head 101R and the nozzle arrays 102RK, 102RC, 102RM, and 102RY in FIG. 2 are the same as those illustrated in FIG. 1, any repetitive description will be omitted. Ink tanks 103LK, 103LC, 103LM, and 103LY are provided in the print head 101L and are configured to store black, cyan, magenta, and yellow inks. The ink tanks storing inks are connected to nozzles of the corresponding colors and configured to supply the inks to the nozzles. Black, cyan, magenta, and yellow ink tanks 103RK, 103RC, 103RM, and 103RY, respectively, are provided in the print head 101R. The ink tanks for inks of four colors of black, cyan, magenta, and yellow are integrated according to this embodiment, and one integrated ink tank is provided in each of the right and left print heads. Therefore, when one of the inks of four colors is used up, the integrated ink tank is to be replaced as a whole even though inks of the other colors still remain in the integrated ink tank.

FIG. 2 illustrates straight lines X1, X2, X3, and X4 representing positions in the scanning direction (X direction) of the print heads on a surface of the recording sheet 106. The ink-jet printer according to this embodiment divides and assigns a region on a recording medium to the print head 101L and the print head 101R for printing. The straight line X1 indicates a left end of a region printable by the print head 101L, the straight line X2 indicates a left end of a region printable by the print head 101R, the straight line X3 indicates a right end of the region printable by the print head 101L, and the straight line X4 indicates a right end of the region printable by the print head 101R. FIG. 2 illustrates regions A1 and A2 representing regions in the X direction on a surface of the recording sheet 106. The region A1 is a first region printable by using the print head 101L, and the region A2 is a second region printable by using the print head 101R. A region A3 is printable by using the print head 101L only, and a region A5 is printable by using the print head 101R only. A region A4 is adjacent to the region A3 and the region A5 and is printable by using both of the print head 101L and the print head 101R. The region A4 is called an overlapped region herein. Therefore, the region A1 includes the region A3 and the region A4, and the region A2 includes the region A4 and the region A5.

Printing may be performed on the region A4 by one of the following three example methods. (1) The 50% of the print head 101L and the print head 101R may be used for printing. (2) The print head 101L may be used to print a left side of a predetermined X position in the region A4, and the print head 101R may be used to print a right side of the X position. (3) The printing rate is changed in stepwise manner for printing such that the usage of the print head 101L increases for printing as the distance to X2 being a left end of the region A4 increases and that the usage of the print head 101R increases for printing as the distance to X3 being a right end of the region A4 increases. The present disclosure may use one of these methods.

Figure 3:
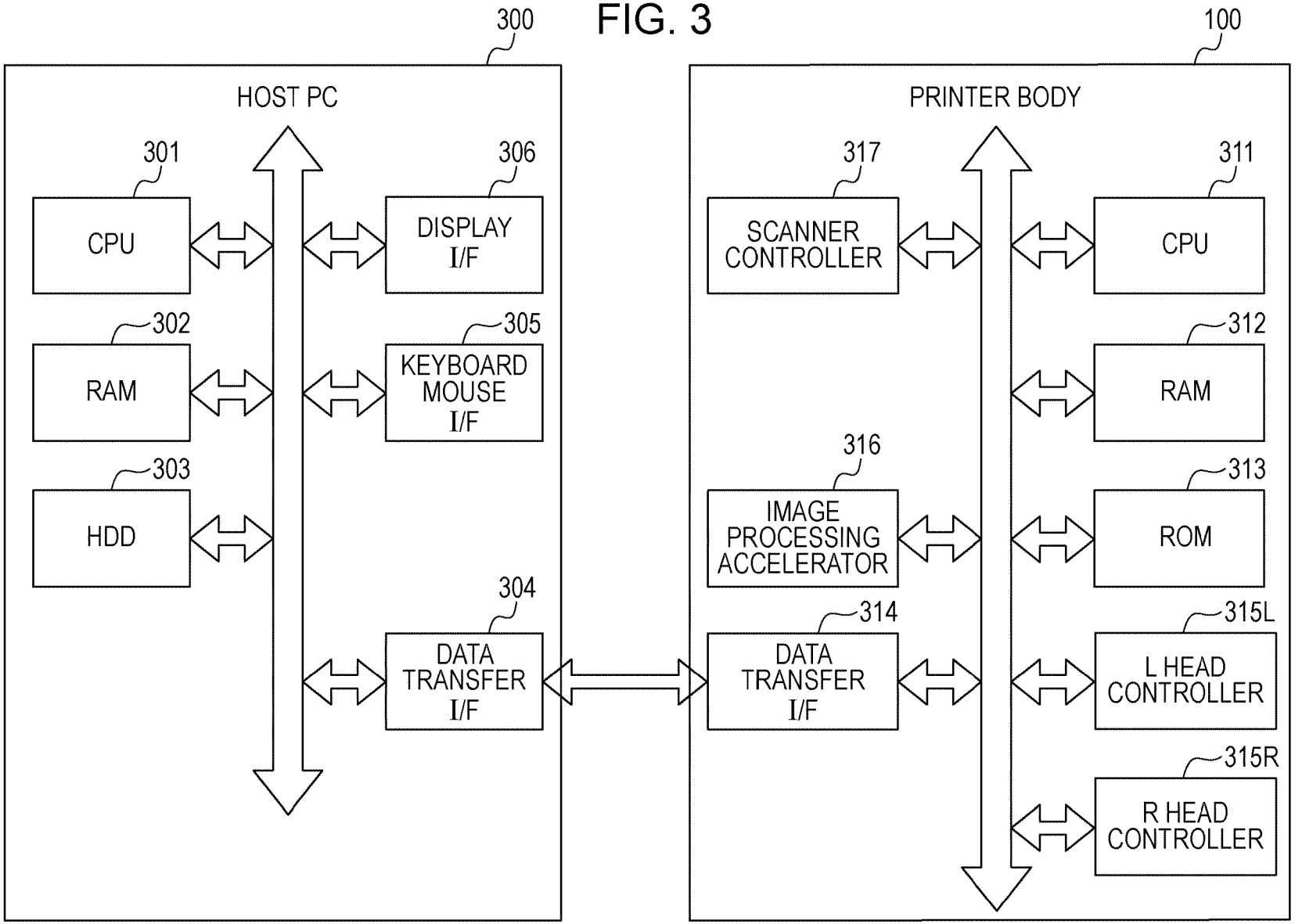
FIG. 3 is a configuration diagram of a printing system according to one or more aspects of the present disclosure.

FIG. 3 is a block diagram illustrating a configuration example of a printing system according to one or more aspects of the present disclosure. As illustrated in FIG. 3, the printing system includes the printer 100 corresponding to the printing apparatus illustrated FIG. 1 and a personal computer (PC) 300 corresponding to the host apparatus therein.

The host PC 300 mainly has the following elements. A CPU 301 is configured to execute processes based on programs held in an HDD 303 and a RAM 302. The RAM 302 is a volatile storage and is configured to temporarily hold a program and data. The HDD 303 is a nonvolatile storage and is configured to hold a program and data. A data transfer interface (I/F) 304 is configured to control transmission and reception of data to and from the printer 100. The data transmission/reception may be performed through a connection system such as a USB, an IEEE 1394, and a LAN. A keyboard/mouse I/F 305 is an interface configured to control an HID (Human Interface Device) such as a keyboard and a mouse, and a user can input through the I/F. A display device I/F 306 is configured to control display on a display device (not illustrated).

On the other hand, the printer 100 mainly includes the following elements. The CPU 311 may execute processes, which will be described below with reference to FIGS. 4A to 4C and subsequent figures, based on programs held in a ROM 313 and a RAM 312. The RAM 312 is a volatile storage and is configured to temporarily hold a program and data. The ROM 313 is a nonvolatile storage and can hold table data generated by the processes, which will be described below with reference to FIGS. 4A to 4C and subsequent figures, and a program.

Figure 8A:
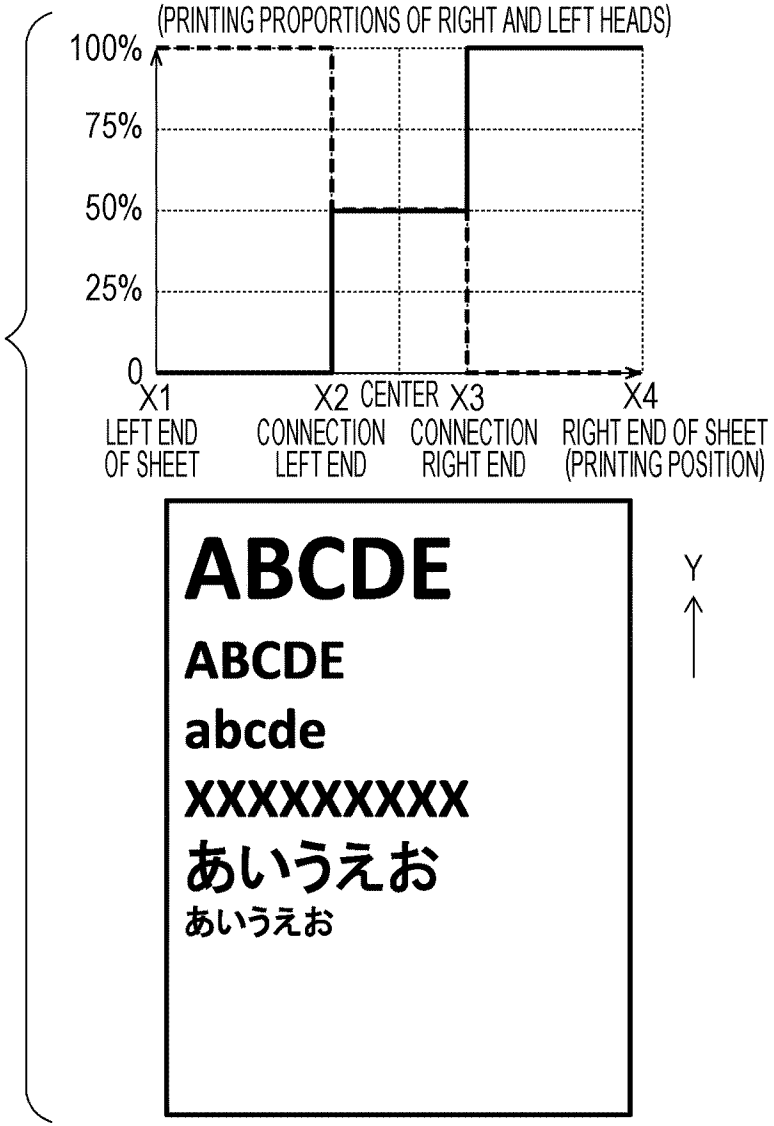
FIGS. 8A and 8B illustrate a printing method for overlapped regions according to one or more aspects of the present disclosure.

A data transfer I/F 314 is configured to control transmission and reception of data to and from the PC 300. A head controller 315L is configured to supply print data to the print head 101L illustrated in FIG. 1 and to control ejection operations performed by the print head 101L. More specifically, the head controller 315L may be configured to read control parameters and print data from a predetermined address in the RAM 312. The CPU 311 is configured to write a control parameter and to print data at the predetermined address in the RAM 312. A process is activated by the head controller 315L, and ink is ejected from the print head 101L. A head controller 315R is also configured to supply print data to the print head 101R illustrated in FIG. 1 and to control an ejection operation performed by the print head 101R. An image processing accelerator 316 is configured by hardware and is configured to execute image processing at higher speed that that of the CPU 311. More specifically, the image processing accelerator 316 may be configured to read parameter data to be used for image processing from a predetermined address in the RAM 312. When the CPU 311 writes the parameter and data to the predetermined address in the RAM 312, the image processing accelerator 316 is activated to perform a predetermined image process. The image processing accelerator 316 may not be a required element. The CPU 311 may perform processing to generate a table parameter as described above and execute an image process based on the specifications of the printer. Normally, the printer 100 is set to perform image processing in order from an upper part of an image displayed on a display device, for example, and to perform printing of it onto a recording medium. FIG. 8A, which will be described below, illustrates a normally set direction (normal direction) of a print image. The image is printed in order from the top to the bottom onto a recording medium conveyed in a Y direction illustrated in FIG. 8A.

Figure 4A:
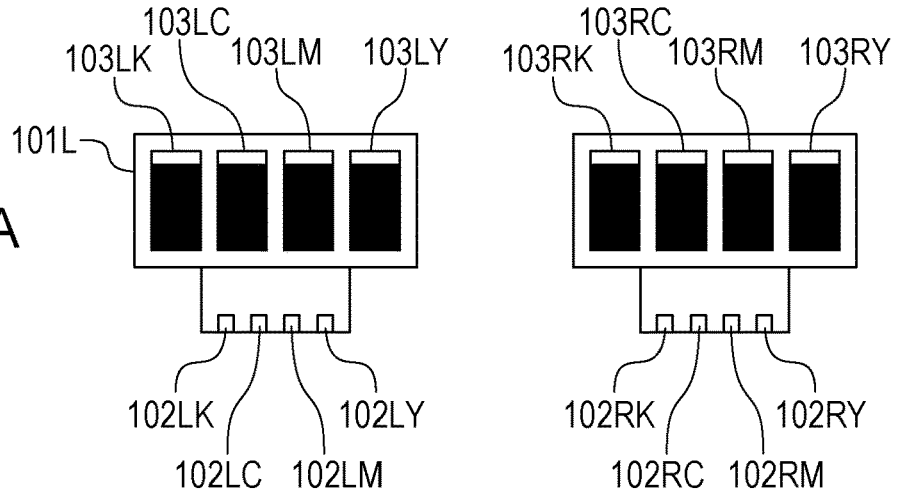
FIGS. 4A to 4C illustrate transitions of remaining amounts of ink in ink tanks according to one or more aspects of the present disclosure.
Figure 4B:
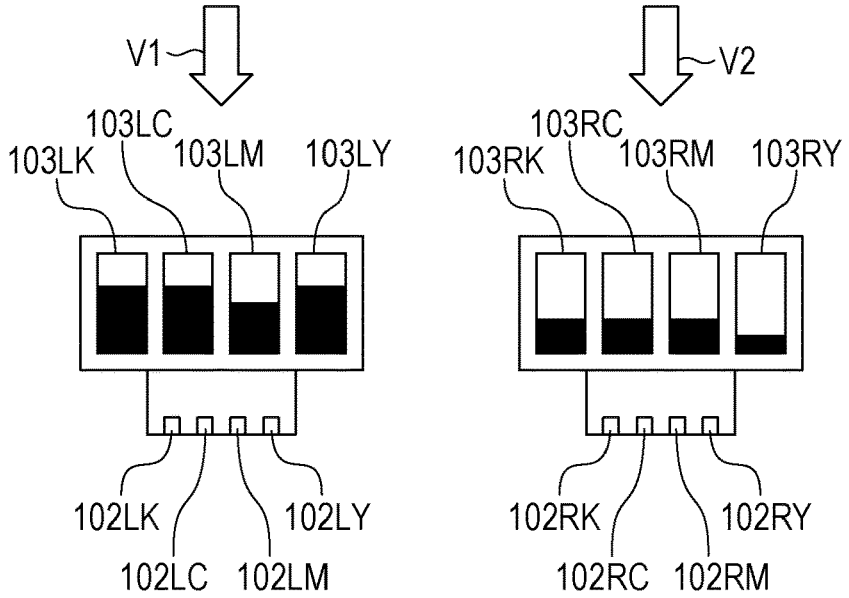
Figure 4C:
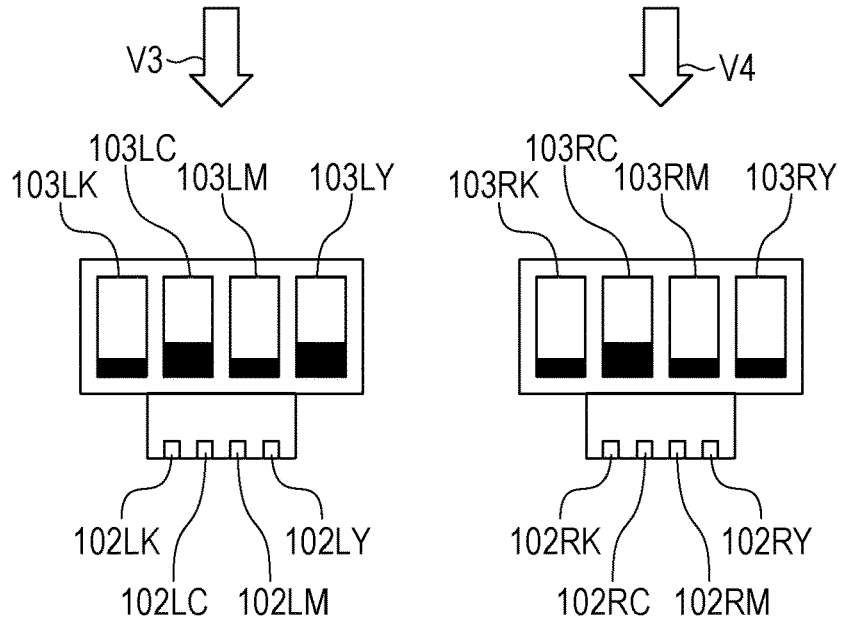

FIGS. 4A to 4C illustrate transitions of remaining amounts of ink in the ink tanks. FIG. 4A illustrates a state immediately after the print head 101L is mounted to the printer 100 corresponding to the printing apparatus. The ink remaining amounts in the black ink tank 103LK, the cyan ink tank 103LC, the magenta ink tank 103LM, and the yellow ink tank 103LY are substantially full.

A certain amount of a document (image data) including more contents on the right side is printed to a recording medium from the state illustrated in FIG. 4A, transitions V1 and V2 illustrated in FIG. 4A occur, resulting in states illustrated in FIG. 4B. In the example in FIGS. 4A to 4C, the remaining amounts of the black ink (103RK), the cyan ink (103RC), the magenta ink (103RM), and the yellow ink (103RY) in the print head 101R are less than those of the inks in the print head 101L. A state in which the difference in remaining amounts in ink tanks is significantly large between the right and left print heads is called "uneven" herein. Continuing the printing with the uneven state may highly possibly result in shortage of ink in one of the ink tanks in the print head 101R. On the other hand, FIG. 4C illustrates an example of ink remaining amounts aimed according to the present disclosure. The remaining amounts in the tanks (103RK, 103RC, 103RM, 103RY) in the print head 101R are substantially equal to the remaining amounts in the tanks (103LK, 103LC, 103LM, 103LY) for the corresponding colors in the print head 101L. Therefore, continuing printing from the state in FIG. 4C may highly possibly result in substantially full use of the ink of the corresponding color in the print head 101L when one of the black ink and the color inks in the print head 101R is used up. Therefore, from the states in FIG. 4B, transitions indicated by V3 and V4 are to be caused to obtain the states in FIG. 4C so that the difference in remaining amount between the tanks corresponding to the right and left heads can be reduced.

On the other hand, according to this embodiment, the direction of the image after the states in FIG. 4B is inverted to increase the ratio of usage of the print head 101L so that the difference in ink remaining amount from that of the print head 101R can be reduced. This may contribute to efficient use of inks within tanks and can increase the printable amount using the mounted ink tanks.

When a certain amount of a document including more contents on the left side (printing region side of the print head 101L) is printed onto a recording medium, the relationship in ink remaining amount between the right and left print heads is inverted. In other words, the remaining amount in the print head 101L is less than the remaining amount in the print head 101R. In this case, the direction of the remaining image is rotated by 180 degrees to increase the ratio of use of the print head 101R so that the difference in remaining amount from that of the print head 101L can be reduced for control for a transition to the state in FIG. 4C.

A user's print document generally has a certain tendency for each user. For example, a document having text thereon in language written horizontally from left to right such as English, Japanese and Chinese may highly possibly have more characters on the left side. A document having text in language written from right to left such as Arabic may highly possibly have more characters on the right side of the document. Therefore, when one identical user uses a printer in the long term, the ink in one of the right and left print heads may be more consumed. In this case, there is a high possibility that ink within one tank of a plurality of tanks corresponding to the right and left print heads may be used up earlier. However, because a user may not always be available for replacing the ink tank at all times, printing may not be continued though inks still remain in the other tanks.

In order to solve this problem, this embodiment inverts the direction of a print document so that the tendency of ink consumption in the right and left tanks can be inverted. This can reduce the difference in ink remaining amount between the right and left tanks and can increase the printable amount using the ink tanks mounted in the printer. When the inversion of the direction of a print image substantially equalize the remaining amounts in the right and left ink tanks, the direction may be returned to the original state.

When the remaining amount of one of the right and left ink tanks is greatly less than the remaining amounts of the other ink tanks as illustrated in FIG. 4B, the image quality may possibly be lowered due to a cause other than the ink shortage. The cause may be "concentration due to evaporation of moisture in ink". As the ratio of volume of the air increases against the volume of ink within a tank, the evaporation of moisture within the ink is promoted. In other words, an increase of the amount of evaporated moisture from the print head 101R in the state in FIG. 4B may disadvantageously result in an increased density of the print image. This embodiment can substantially equalize the ink remaining amounts in the right and left ink tanks and can thus advantageously prevent the difference in tint between images printed by the right and left print heads due to the difference in amount of evaporated moisture.

A method according to this embodiment which controls the remaining amounts in tanks for supplying a black ink to the print head 101L and print head 101R to increase the printable amount will be described with focus on the black inks in the print head 101L and the print head 101R.

Figure 5:
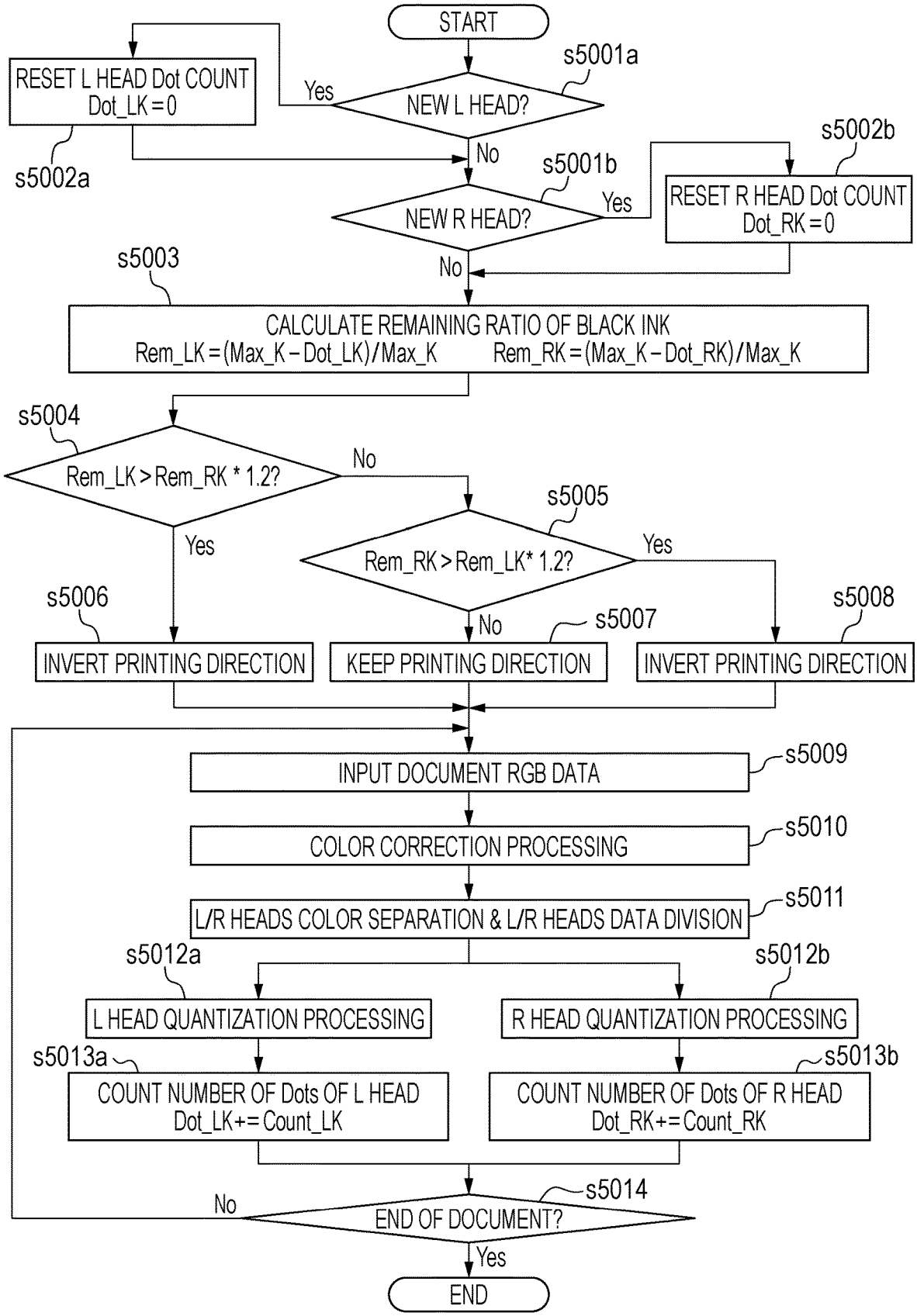
FIG. 5 is a processing flowchart according to one or more aspects of the present disclosure.

FIG. 5 illustrates a processing flow according to one or more aspects of the present disclosure. The processing flow is in a divided mode for performing divided printing by the print head 101L and print head 101R equipped in the printer 100 illustrated in FIG. 1. The CPU 311 illustrated in FIG. 3 executes the processing job by job. Typically, one job contains one or more pages of a document.

The printing flow starts from step s5001*a* where whether the print head 101L equipped in the printer is new is determined. If it is determined as a new head, the processing moves to step s5002*a* where the count (Dot count) of the number of times of ejection from the head is reset. Then, the processing moves to step s5001*b*. If it is determined in step s5001*a* that the head is not new and is to be continuously used, the Dot count for the number of times of ejection up to the current point is to be continuously used. Thus, the processing directly moves to step s5001*b*.

In step s5001*b*, whether the print head 101R equipped in the printer is new is determined. If it is determined as a new head, the processing moves to step s5002*b* where the Dot count corresponding to the number of ejection from the head is reset. The processing them moves to step s5003. If it is determined in step s5001*b* where the head is not new and is to be continuously used, the Dot count up to the current point is to be continuously used. The processing then directly moves to step s5003.

In step s5003, the remaining ratio of a black ink in each of the right and left print heads is obtained by calculation using the following formula. Then the calculated remaining ratio are stored in RAM 312.

$$\text{Rem_}LK=(\text{Max_}K-\text{Dot_}LK)/\text{Max_}K$$

$$\text{Rem_}RK=(\text{Max_}K-\text{Dot_}RK)/\text{Max_}K$$

Here, Rem_LK represents the remaining ratio of a black ink in the print head 101L, and 1.0 indicates a full state while 0.0 indicates an ink shortage state. Rem_RK represents the remaining ratio of a black ink in the print head 101R, and 1.0 indicates a full state while 0.0 indicates an ink shortage state also.

Max_K is a maximum printable pixel count, that is, a constant representing a maximum ejectable Dot count when an ink tank for a black ink is full and can be determined based on the size of the ink tank and the discharge amount of the print head. According to this embodiment, Max_K is common in the print head 101L and the print head 101R.

Dot_LK is the number of times of ejection (Dot count) of black ink during a period from the mounting of a new print head 101L integrated to the ink tanks to the determination. Also, Dot_RK is the number of times of ejection (Dot count) of the black ink during a period from the mounting of a new print head 101R integrated to the ink tanks to the determination.

Next, in step s5004, whether the remaining amount of the black ink in the print head 101L is larger than the remaining amount of the black ink in the print head 101R by a predetermined multiple is decided. According to this embodiment, whether the remaining amount of the black ink in the print head 101L is larger than the remaining amount of the black ink in the print head 101R by 1.2 times is decided by using the following formula.

$$\text{Rem_}LK>\text{Rem_}RK*1.2$$

Here, if the decision results in Yes and when the remaining amount of the black ink in the print head 101L is larger than the remaining amount of the black ink in the print head 101R by 1.5 times, for example, the black ink in the print head 101R is significantly less. The processing then moves to step s5006 where the direction of the printing processing of the document, which will be described below, is set to the "opposite direction". Then, the processing moves to step s5009.

On the other hand, if the decision in step s5004 results in No, the processing moves to step s5005. In step s5005, whether the remaining amount of the black ink in the print head 101R is larger than the remaining amount of the black ink in the print head 101L by a predetermined multiple is decided. According to this embodiment, whether the remaining amount of the black ink in the print head 101R is larger than the remaining amount of the black ink in the print head 101L by 1.2 times is decided by using the following formula.

$$\text{Rem_}RK>\text{Rem_}LK*1.2$$

Here, if the decision results in Yes and when the remaining amount of the black ink in the print head 101R is larger than the remaining amount of the black ink in the print head 101L by 1.5 times, for example, the black ink in the print head 101L is significantly less. The processing then moves to step s5008 where the direction of the printing processing of the document, which will be described below, is set to the "opposite direction". Then, the processing moves to step s5009.

If the decision results in No in step s5005, the difference between the remaining amount of the black ink in the print head 101L and the remaining amount of the black ink in the print head 101R is equal to or lower than the other by 1.2 times. In other words, when the remaining amounts of black ink in the right and left ink tanks are substantially equal, the remaining amounts differ slightly. In this case, the processing moves to step s5007 where the printing direction for the document, which will be described below, is set to "normal printing direction (normal direction)". The processing moves to step s5009.

The decisions in step s5004 and step s5005 are based on an exemplary constant of 1.2 and the exemplary decision formula but may be based on another constant or a decision method. Referring to the example in FIG. 5, the decisions are based on ration of the remaining amounts of the black inks in the right and left tanks. However, for example, whether the difference between the remaining amounts is equal to or lower than a predetermined amount may be decided, or whether the difference between the remaining amounts is larger than a predetermined amount may be decided to invert the direction of the print document.

For example, instead of the formula in step s5004, the following formula may be used.

$$\text{Rem_}LK-\text{Rem_}RK>Th$$

Here, Th is a threshold value for a difference between the remaining amounts and may be set to Th=Max_K/2, for example.

If the direction of the print image is set in step s5004 to s5008 as described above, the processing moves to step s5009. In step s5009 to step s5014, image processing is actually performed on image data of the document. In step s5009, an RGB image of the document is input. In this case, the image is input based on the "printing direction of the document" set in one of steps s5006 to s5008. In step s5007, if "normal direction" is set, the image data is obtained from a beginning position (top part), and a trailing end (bottom) is obtained finally. In other words, the top part of the image data is printed on the downstream side in the conveying direction of a recording medium, and the bottom part of the image data is printed on the upstream side of the conveying direction. If the "opposite direction" is set in one of steps s5006 to s5008, the image data is obtained from the trailing end (bottom part), and the leading edge (top part) thereof is obtained finally. In other words, the bottom part of the image data is printed on the downstream side in the conveying direction of a recording medium, and the top part of the image data is printed on the upstream side in the conveying direction. This means that the image printed on the recording sheet 106 is different by 180 degrees between printing in the normal direction and printing in the opposite direction.

Even when inverting the direction of a print image is determined in this flow, the set printing direction is limited in the job and is not stored in the printer 100. When this flow ends and the next job is input, printing in the normal direction is assumed again, and whether the direction is to be inverted or not is determined.

In step s5010, color correction processing is performed which converts RGB colors of the document to RGB values for printing. The color correction processing may be any known type of processing. In step s5011, L/R heads color separation processing and L/R heads data division processing are performed which convert the RGB values to the application amounts of black, cyan, magenta, yellow inks in the print head 101L and print head 101R. Here, the color separation processing may apply any known scheme. For easy understanding, this embodiment assumes a case where values Rin, Gin, and Bin are input in the color separation processing. It is further assumed that the print head 101L outputs values LKout, LCout, LMout, and LYout and that the print head 101R outputs values RKout, RCout, RMout, and RYout. These values are processed based on the following calculation formulas. Here, Rin, Gin, Bin, and LKout, LCout, LMout, LYout, RKout, RCout, RMout, and RYout are 8-bit values and range from 0 to 255.

$$C=255-R\text{in}$$

$$M=255-G\text{in}$$

$$Y=255-B\text{in}$$

$$K=\min(C,M,Y)$$

$$C'=C-K$$

$$M'=M-K$$

$$Y'=Y-K$$

Next, different processes to be performed on the regions A3, A4, and A5 in FIG. 2 will be described in detail. The application amounts for the region A3 may be calculated by the following calculation formulas.

$$LK\text{out}=LK_\text{Table}[K]$$

$$LC\text{out}=C'+LC_\text{Table}[K]$$

$$LM\text{out}=M'+LM_\text{Table}[K]$$

$$LY\text{out}=Y'+LY_\text{Table}[K]$$

(RKout, RCout, RMout, RYout=0)

Here, LK_Table, LC_Table, LM_Table, and LY_Table are color separation tables for the print head 101L, which are usable for setting the application amounts of K, C, M, and Y inks for obtaining a density K for a gray image. According to this embodiment, color separation tables illustrated in FIG. 7 may be used.

The application amounts for the region A5 may be calculated by the following calculation formulas.

$$RK\text{out}=RK_\text{Table}[K]$$

$$RC\text{out}=C'+RC_\text{Table}[K]$$

$$RM\text{out}=M'+RM_\text{Table}[K]$$

$$RY\text{out}=Y'+RY_\text{Table}[K]$$

(LKout, LCout, LMout, LYout=0)

Here, RK_Table, RC_Table, RM_Table, and RY_Table are color separation tables for the print head 101R, which are usable for setting the application amounts of K, C, M, and Y inks for obtaining a density K for a gray image. According to this embodiment, color separation tables illustrated in FIG. 7 may be used.

The application amounts for the region A4 may be calculated by the following calculation formulas.

$$LK\text{out}=LK_\text{Table}[K]\times a1+RK_\text{Table}[K]\times b1$$

$$LC\text{out}=(C'+LC_\text{Table}[K])\times a2+(C'+RC_\text{Table}[K])\times b2$$

$$LM\text{out}=(M'+LM_\text{Table}[K])\times a3+(M'+RM_\text{Table}[K])\times b3$$

$$LY\text{out}=(Y'+LY_\text{Table}[K])\times a4+(Y'+RY_\text{Table}[K])\times b4$$

$$RK\text{out}=LK_\text{Table}[K]\times c1+RK_\text{Table}[K]\times d1$$

$$RC\text{out}=(C'+LC_\text{Table}[K])\times c2+(C'+RC_\text{Table}[K])\times d2$$

$$RM\text{out}=(M'+LM_\text{Table}[K])\times c3+(M'+RM_\text{Table}[K])\times d3$$

$$RY\text{out}=(Y'+LY_\text{Table}[K])\times c4+(Y'+RY_\text{Table}[K])\times d4$$

Here, a1 to a4, b1 to b4, c1 to c4, and d1 to d4 are coefficients to be determined based on the type of printing to be performed on the printing region A4 by the print head 101L and the print head 101R.

For the aforementioned exemplary three types of printing methods for the printing region A4, the following settings may be applied for printing.

Figure 8B:
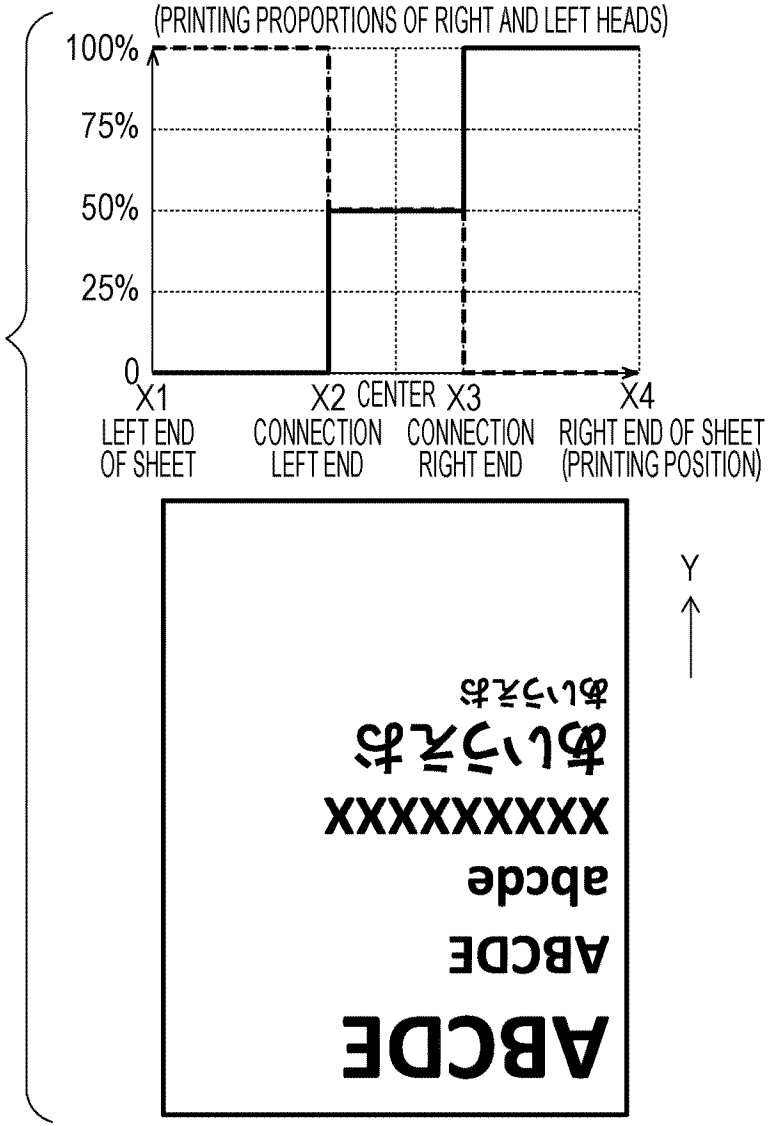

A first method applies the print head 101L 50% and the print head 101R 50%. Setting as a1 to a4=0.25, b1 to b4=0.25, c1 to c4=0.25, and d1 to d4=0.25 can equalize the printing ink amounts between the right and left heads. FIG. 8A illustrates a conceptual image of printing in the normal direction according to this method, FIG. 8B illustrates a conceptual image of printing in the opposite direction according to this method. Referring to FIGS. 8A and 8B, the relationship in printable amount between the right and left print heads is inverted.

Figure 9A:
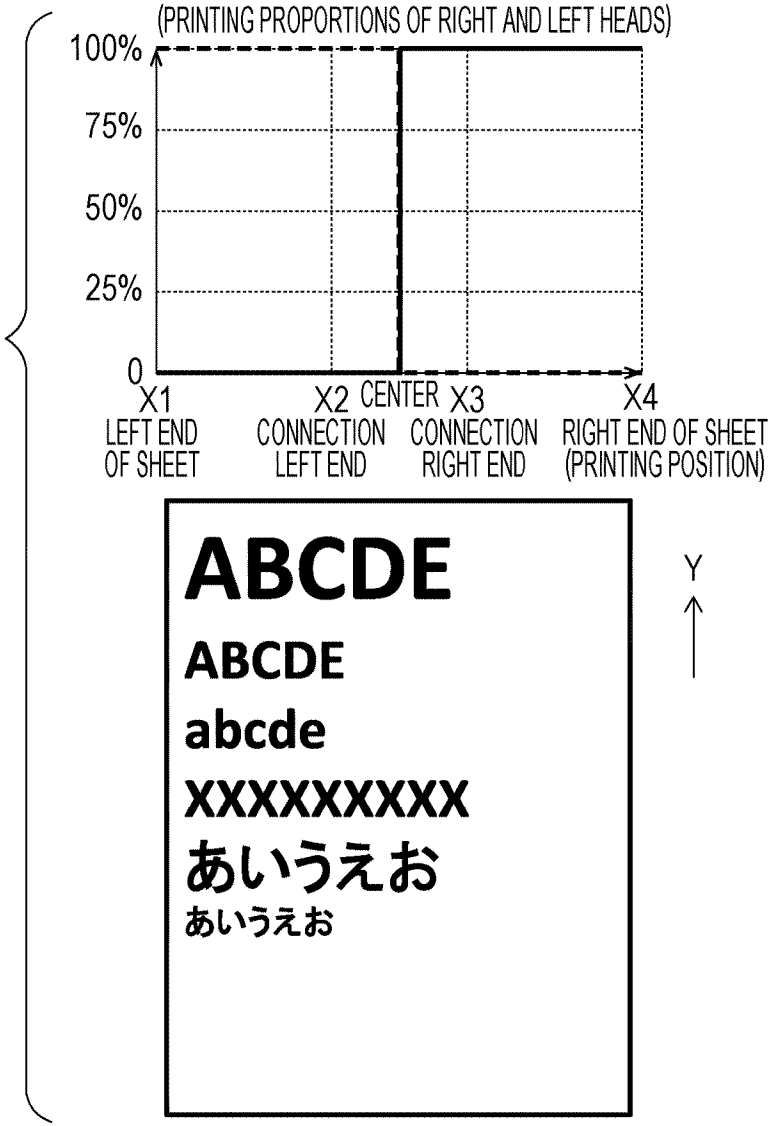
FIGS. 9A and 9B illustrate a printing method for overlapped regions according to one or more aspects of the present disclosure.
Figure 9B:
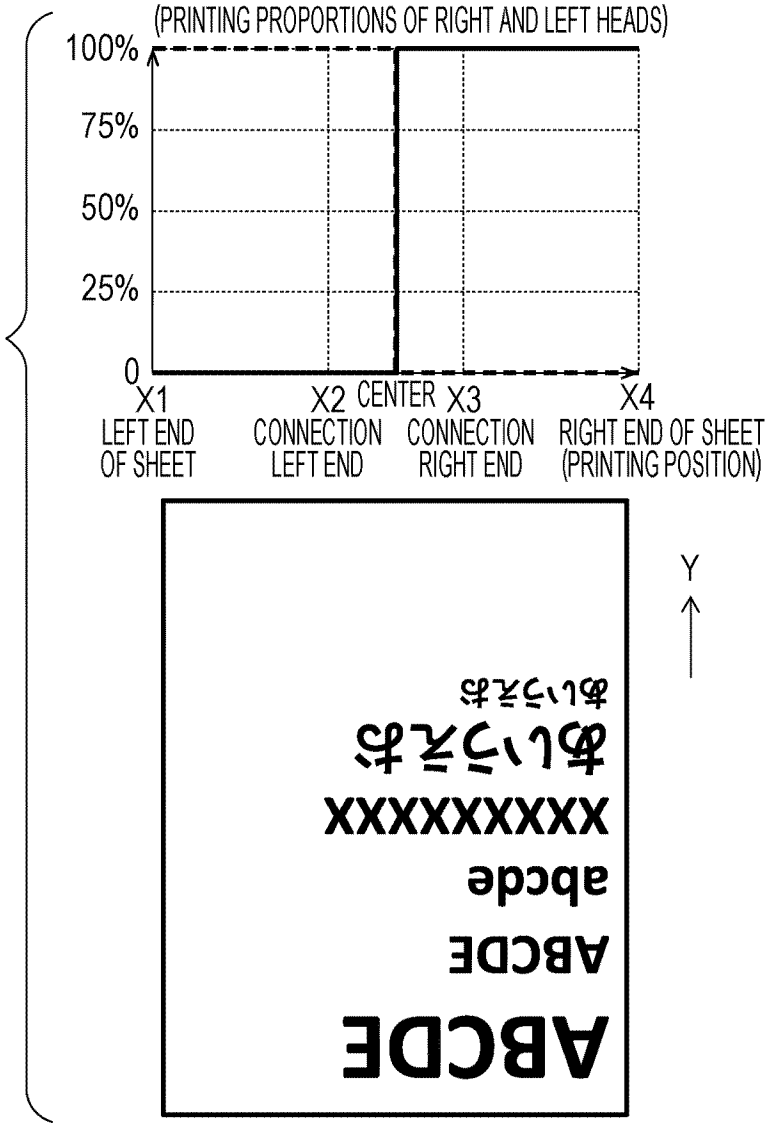

Next, a second method prints a left side of a predetermined X position in the region A4 by using the print head 101L and prints a right side of the predetermined X position in the region A4 by using the print head 101R. The pixels on the left side of the predetermined X position include a1 to a4=1.00, b1 to b4=0.00, c1 to c4=0.00, and d1 to d4=0.00. The pixels on the right side of the predetermined X position include a1 to a4=0.00, b1 to b4=0.00, c1 to c4=0.00, and d1 to d4=1.00. FIG. 9A illustrates a conceptual image of printing in the normal direction according to this method, FIG. 9B illustrates a conceptual image of printing in the opposite direction according to this method. Also referring to FIGS. 9A and 9B, the relationship in printable amount between the right and left print heads is inverted.

Next, a third method prints by changing the printing ration of the print head 101L and the print head 101R in stepwise manner such that the usage of the print head 101L increases as the distance from the center of the region A4 to the left end on the left side decreases and such that the usage of the print head 101R increases as the distance from the center of the region A4 to the right end on the right side decreases.

$$a1 \text{ to } a4=(w-x)/w*(w-x)/w,$$

$$b1 \text{ to } b4=x/w*(w-x)/w$$

$$c1 \text{ to } c4=x/w*x/w,$$

$$d1 \text{ to } d4=(w-x)/w*x/w$$

Figure 10A:
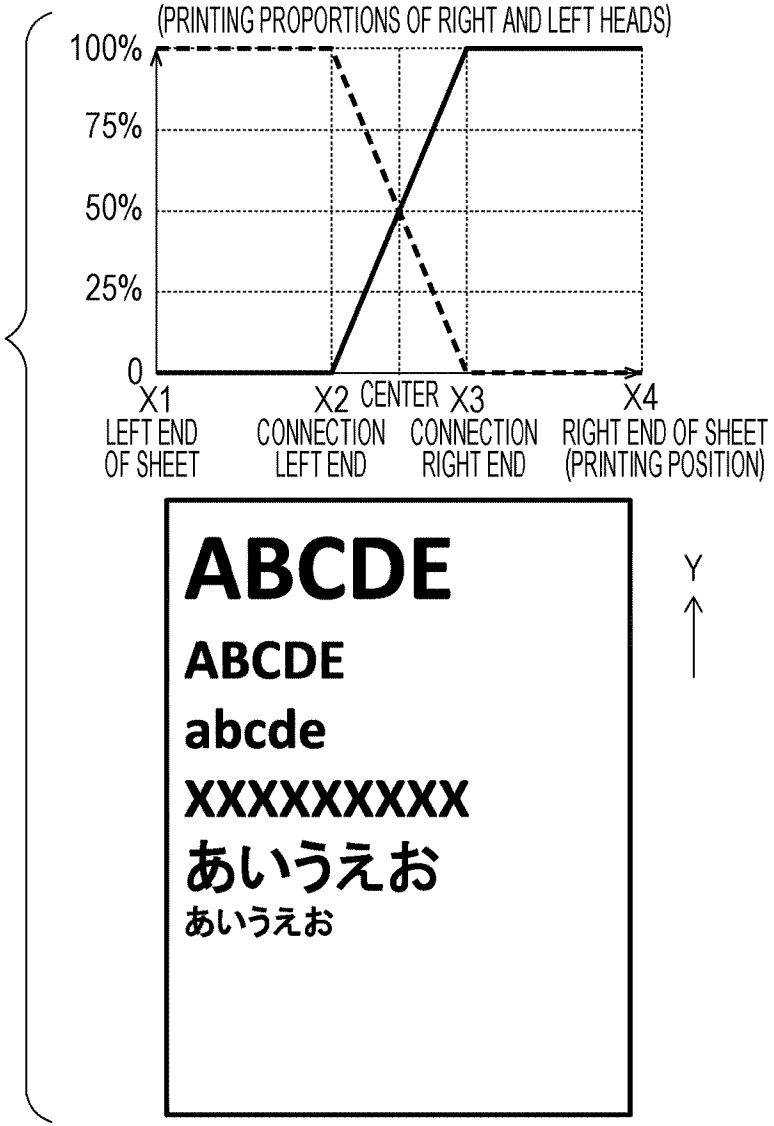
FIGS. 10A and 10B illustrate a printing method for overlapped regions according to one or more aspects of the present disclosure.
Figure 10B:
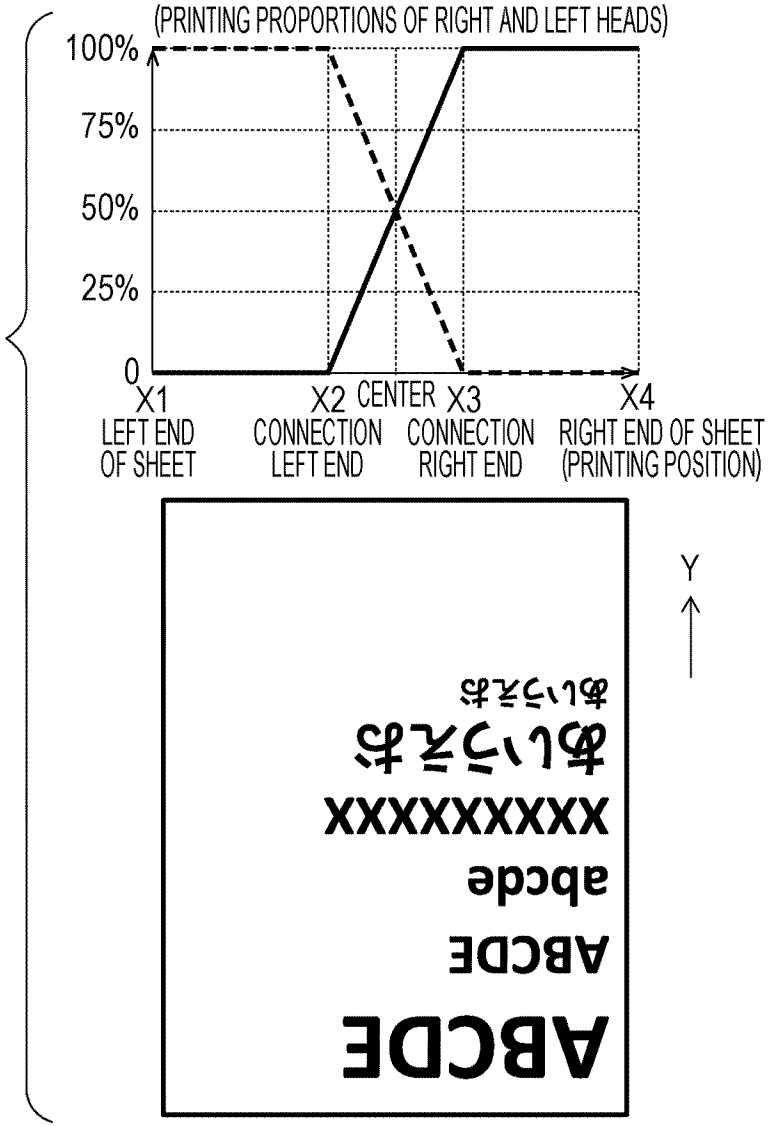

Here, w is a width (pixel count) of the region A4, and x is the pixel position of a pixel to be processed and corresponding to the pixel position (pixel count) from the left end of the region A4. Therefore, x=0 at the left end of the region A4 and x=w at the right end of the region A4. FIG. 10A illustrates a conceptual image of printing in the normal direction according to this method, and FIG. 10B illustrates a conceptual image of printing in the opposite direction according to this method. Also referring to FIGS. 10A and 10B, the relationship in printable amount between the right and left print heads is inverted.

The processing in step s5011 results in LKout, LCout, LMout, and LYout on region A1(A3+A4) in FIG. 2 which are output data from the print head 101L. The print head 101R outputs data of RKout, RCout, RMout, and RYout on the region A2 (A4+A5) in FIG. 2.

The coefficients a1 to a4, b1 to b4, c1 to c4, and d1 to d4 have been described in the example that the printing region A4 undergoes printing in a case where dots are ideally arranged on the recording sheet 106 with sufficiently less ink blur. When the printer 100 is actually used for printing, coefficients may be set against variations in printing states of dots and against ink blur. Having described that, according to this embodiment, the coefficients a1 to a4, b1 to b4, c1 to c4, d1 to d4 are used to calculate and output values, an input/output conversion table reflecting those coefficients may be calculated in advance for each recording pixel position for processing.

Figure 7:
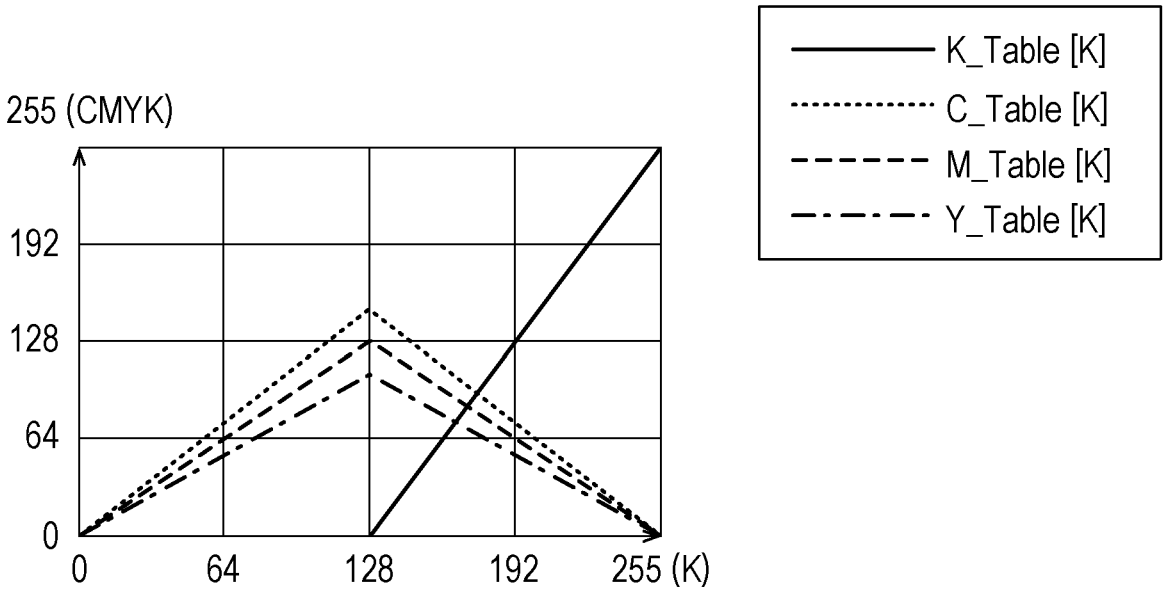
FIG. 7 illustrates conversion data to be used for a color separation process according to one or more aspects of the present disclosure.

FIG. 7 illustrates conversion data examples to be used in color separation processing according to one or more aspects of the present disclosure. This color separation processing generates data representing application amounts of inks based on input image data. Each of the conversion data examples corresponds to a conversion table for color separation to a gray image from a target density of 0 to a target density of 255. As the numerical value decreases, the density of the gray decreases. As the numerical value increases, the density of gray increases up to a highest density of 255. Because the color separation tables for the print head 101L and the color separation tables for the print head 101R are commonly applicable, they will be called K_Table, C_Table, M_Table, and Y_Table below. The color separation tables, which will be described below, are conversion tables for outputting CMYK values from input CMYK values. The horizontal axis in the tables indicates black (K) values of 256 gray scale of 0 to 255. This is equivalent to a gray image of C=M=Y=0. The vertical axis therein indicates C, M, Y, and K output values regarding the application amounts of the respective inks. The input values to the color separation tables according to the present disclosure are not limited to CMYK values but may be RGB values. When RGB values are input thereto, this results in a gray image of R=G=B where the horizontal axis may be any one of the R, G, B values.

A horizontal axis represents a target density K in a gray image, and a vertical axis represents application amounts of black, cyan, magenta, yellow inks to be used for obtaining the target density K in the gray image. Referring to FIG. 7, the gray image is obtained only with chromatic color inks of cyan, magenta, and yellow on a lower gray scale side having gray target densities of 0 to 128, and the amounts of the inks monotonously increase. In this case, the application amount of the black ink is equal to 0. The application amounts of the black ink is larger than 0 from an intermediate density. The gray image having target densities of 129 to 254 is obtained by using both of the black ink and the chromatic color inks. On a higher gray scale side, the application amount of the black ink monotonously increases, and the application amount of the chromatic color inks monotonously decrease. The gray image having a target density of 255 being the highest density is obtained with the black ink, without the chromatic color inks.

Referring back to the processing flow in FIG. 5, in step s5012*a*, quantization processing is performed which converts data of LKout, LCout, LMout, LYout representing the ink application amounts in the print head 101L to Dot data indicating the presence or absence of dots to be actually printed. The presence or absence of a Dot indicates an instruction to eject inks or not from the nozzles in the print head 101L. In step s5012*b*, quantization processing is performed which converts data of RKout, RCout, RMout, RYout representing the ink application amounts in the print head 101R to Dot data indicating the presence or absence of dots to be actually printed. The presence or absence of a Dot indicates an instruction to eject inks or not from the nozzles in the print head 101R. The quantization processing may apply any scheme such as the known error diffusion processing and dithering processing. The quantized Dot data are transmitted to the print heads, and when Dot data for one scan to be performed by the print heads are ready, actual image printing using the print head 101L and the print head 101R is performed on the recording sheet 106.

In step s5013*a*, based on the Dot data quantized for the print head 101L, the Dot count is measured for accumulation processing by using the following calculation formula.

$$Dot_LK += Count_LK$$

where Count_LK is a printing Dot count for the black ink in the print head 101L.

In step s5013*b*, based on the Dot data quantized for the print head 101R, the Dot count is obtained for accumulation processing by using the following calculation formula.

$$Dot_RK += Count_RK$$

where Count_RK is a printing Dot count for the black ink in the print head 101R.

This embodiment prints an image and does not consider consumption of inks other than ink to be ejected onto the recording sheet 106 for convenience of description. However, considering consumption of ink not to be used for printing an image but to be ejected to outside of a recording medium for so-called preliminary discharging an image can increase the accuracy of estimation of the ink remaining amounts.

In step s5014, whether all pixels corresponding to image data on a document to be printed have been completely processed is decided. If the decision results in Yes, the printing flow ends. The Dot_LK information and Dot_RK information cumulatively calculated up to this point may be stored in the ROM 313 and are to be used for a printing flow in response to input of the next job. In step s5014, if the decision results in No, the processing returns to step s5009 where the remaining part of the document is processed. The processing in step s5009 to step s5014 is then repeated until the end of the document. The processing in step s5001 to s5014 may be repeated many times so that processing, which will be described below, can be performed. While a document which does not cause a significant difference in ink remaining amount between the right and left print heads is being printed, the printing in the normal direction is selected in step s5007 at all times. While a document having more print data on the right side is being printed, printing in the opposite direction is selected in step s5006 when the difference in ink remaining amount between the right and left print heads exceeds a predetermined amount. When the difference in ink remaining amount between the right and left print heads becomes equal to or lower than the predetermined amount and the unevenness is overcome, the printing in the normal direction is selected in step s5007. While a document having more print data on the left side is being printed, the printing in the opposite direction is selected in step s5008 when the difference in ink remaining amount between the right and left print heads exceeds the predetermined amount. When the difference in ink remaining amount between the right and left print heads becomes equal to or lower than the predetermined amount and the unevenness is overcome, the printing in the normal direction is selected in step s5007.

The consumed amounts of the black ink in each of the print head 101L and the print head 101R are added to estimate the remaining amount of the ink in the corresponding tank, as described above. Then, the direction of a print image is controlled to be inverted based on the difference in remaining amount of the black ink in the print heads so that the consumption rates of black ink in the print heads can get close to reduce the difference in remaining amounts therebetween. This control can increase the printable amount using the black ink tanks corresponding to the print head 101L and the print head 101R.

While this embodiment performs the decisions by defining the black ink as a mainly used ink, the decisions are not limited to black ink but may be applicable to ink of any color. The difference in remaining amount in right and left ink tanks may be detected for each of all ink colors, and when the maximum value of the difference exceeds a predetermined amount, the direction of a print image may be controlled to be inverted.

Second Embodiment

According to the first embodiment, the printing direction is controlled based on the remaining amounts of black ink in the tanks corresponding to the print head 101L and the print head 101R to reduce the difference in remaining amount. According to a second embodiment, the direction of a print image is controlled in consideration of a difference in ink consumption rate between the print head 101L and the print head 101R based on the remaining amounts of all inks of black and chromatic colors.

Figure 6A:
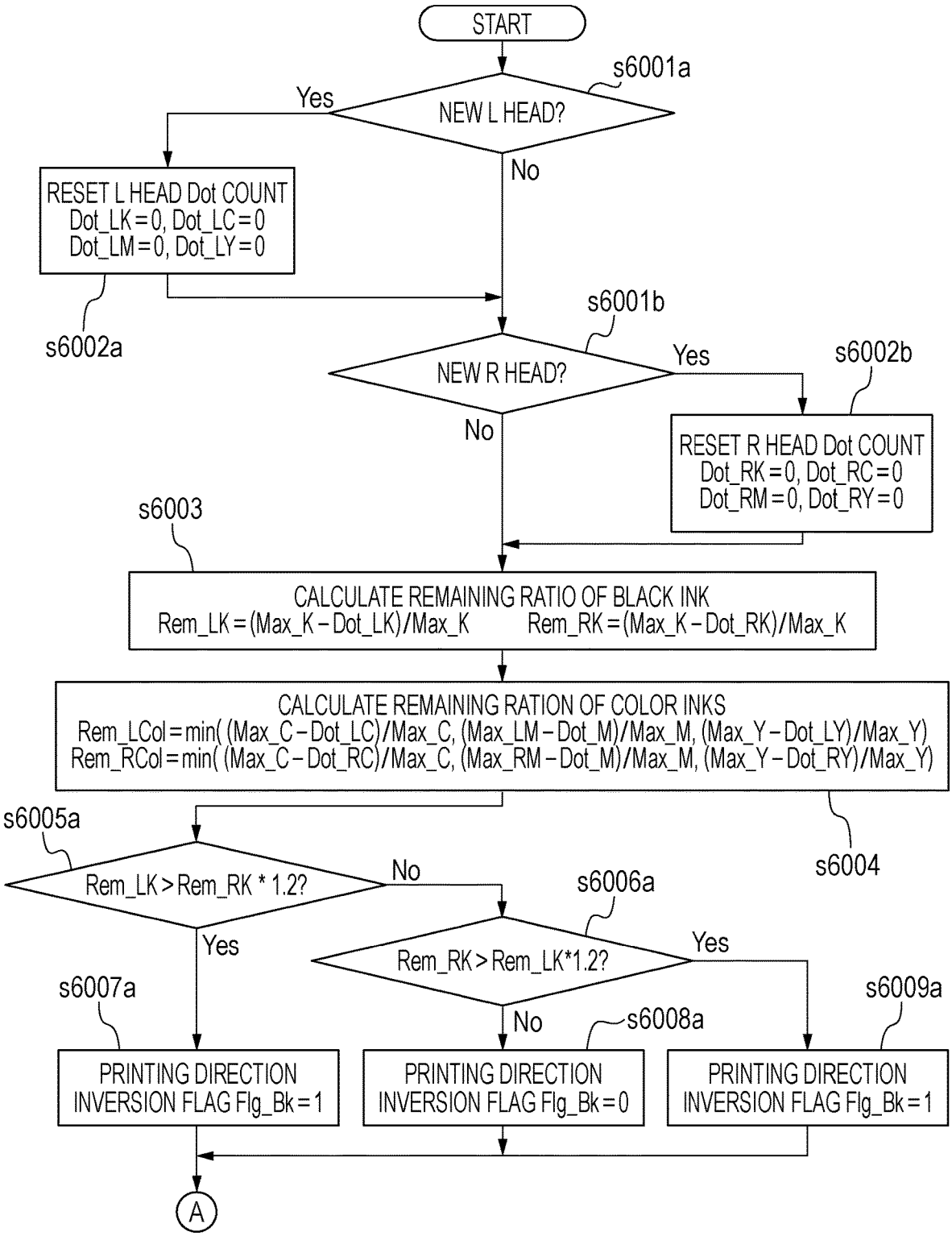
FIGS. 6A and 6B illustrate a processing flowchart according to one or more aspects of the present disclosure.
Figure 6B:
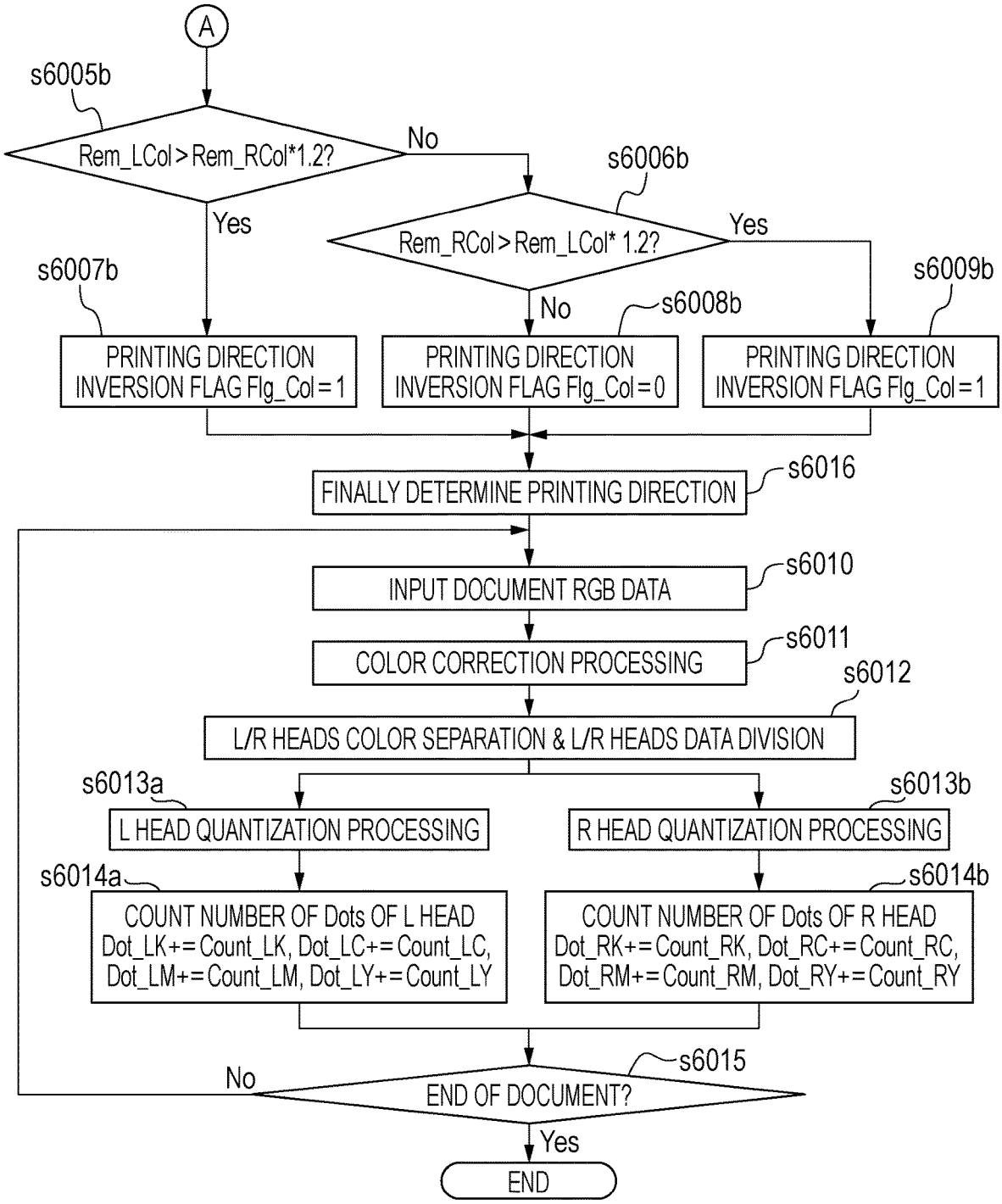

FIGS. 6A and 6B illustrate a processing flow according to one or more aspects of the present disclosure. First, the printing flow starts from step s6001*a* where whether the print head 101L that is being used is a new head is determined. If it is determined as a new head, the processing moves to step s6002*a* where the Dot count printed by using the head is reset. Then, the processing moves to step s6001*b*. If it is determined in step s6001*a* that the head is not new and is to be continuously used, the Dot count for the printing up to the current point is to be continuous used. Thus, the processing directly moves to step s6001*b*.

In step s6001*b*, whether the print head 101R to be used is a new head is determined. If it is determined as a new head, the processing moves to step s6002*b* where the Dot count printed by using the head is reset. Then, the processing moves to step s6003. If it is determined in step s6001*b* that the head is not new and is to be continuously used, the Dot count for the printing up to the current point is to be continuous used. Thus, the processing directly moves to step s6003. Because the processing in step s6003 is the same as the processing in step s5003 in FIG. 5, any repetitive description will be omitted.

Next, in step s6004, the remaining ratios of the chromatic color inks are calculated.

$$\text{Rem_}L\text{Col}=\min((\text{Max_}C-\text{Dot_}LC)/\text{Max_}C,(\text{Max_}M-\text{Dot_}LM)/\text{Max_}M,(\text{Max_}Y-\text{Dot_}LY)/\text{Max_}Y)$$

$$\text{Rem_}R\text{Col}=\min((\text{Max_}C-\text{Dot_}RC)/\text{Max_}C,(\text{Max_}M-\text{Dot_}RM)/\text{Max_}M,(\text{Max_}Y-\text{Dot_}RY)/\text{Max_}Y)$$

Here, Rem_LCol represents the remaining ratio of a chromatic color ink in the print head 101L, and 1.0 indicates a full state while 0.0 indicates an ink shortage state. Rem_RCol represents the remaining ratio of a chromatic color ink in the print head 101R, and 1.0 indicates a full state while 0.0 indicates an ink shortage state.

Max_C, Max_M, and Max_Y are constants representing maximum pixel counts printable in colors of cyan, magenta, yellow, that is, maximum ejectable Dot counts when the corresponding ink tanks are full and are determined based on the sizes of the ink tanks and the discharge amount of the corresponding print head. According to this embodiment, Max_C, Max_M, and Max_Y are equal in the print head 101L and the print head 101R.

Dot_LC, Dot_LM, and Dot_LY are Dot counts of colors of inks ejected during a period from a time when the print head 101L integrated to the ink tanks is newly mounted to the time of the determination. According to this embodiment, Rem_LCol is a minimum value of the remaining ration of inks cyan, magenta, and yellow and corresponds to a remaining ratio of the least remaining ink. Also, Dot_RC, Dot_RM, and Dot_RY are Dot counts of colors of inks ejected during a period from a time when the print head 101R integrated to the ink tanks is newly mounted to the time of the determination. According to this embodiment, Rem_RCol is a minimum value of the remaining ration of inks cyan, magenta, and yellow and corresponds to a remaining ratio of the least remaining ink.

Because the processing in step s6005*a* to step s6009*a* is the same as the processing in step S5004 to step s5008 in FIG. 5, any repetitive descriptions will be omitted. However, according to this embodiment, the printing direction is set as a flag here because the direction of a print image is not fixed in this step but is determined in step s6016 where the printing direction is finally determined. If it is determined that the direction of the print image is to be inverted in step s6007*a* or s6009*a*, a printing direction inversion flag of Flg_Bk=1 is set. If it is determined in step s6008*a* that the direction of the print image is not to be inverted, a printing direction inversion flag of Flg_Bk=0 is set.

When the processing in steps s6005*a* to s6009*a* completes, the processing moves to step s6005*b*.

In steps s6005*b* to s6009*b*, the same processing as that in steps s6005*a* to s6009*a* is performed. Here, the remaining ratio (Rem_LCol) of the least remaining ink of the chromatic color inks corresponding to the print head 101L and the remaining ratio (Rem_RCol) of the most remaining ink of the chromatic color inks corresponding to the print head 101R is compared. Then, whether the difference is higher than a predetermined amount or not is decided. According to this embodiment, whether one is more than the other by 1.2 times is decided. The comparison here is not limited to inks of an identical color.

These steps apply the following decision formulas.

$$\text{step } s6005b\text{: Rem_}L\text{Col}>\text{Rem_}R\text{Col}*1.2$$

$$\text{step } s6006b\text{: Rem_}R\text{Col}>\text{Rem_}L\text{Col}*1.2$$

The processing moves to step s6007*b* in a state where the remaining amount of the least remaining ink of the chromatic color inks in the print head 101R is significantly lower than the remaining amount of the least remaining ink of the chromatic color inks in the print head 101L. In this case, the printing direction inversion flag is set to "Flg_Col=1 (opposite direction)". The processing moves to step s6009*b* in a state where the remaining amount of the least remaining ink of the chromatic color inks in the print head 101L is significantly lower than the remaining amount of the least remaining ink of the chromatic color inks in the print head 101R. In this case, the printing direction inversion flag is set to "Flg_Col=1 (opposite direction)". The processing moves to step s6008*b* in a state where the remaining amount of the least remaining ink of the chromatic color inks in the print head 101L is not significantly different from the remaining amount of the least remaining ink of the chromatic color inks in the print head 101R. In this case, the printing direction inversion flag is set to "Flg_Col=0 (normal direction)".

The printing direction is set as a flag here because the direction of a print image is determined in step s6016 where the printing direction is finally determined. If it is decided that the direction of the print image is to be inverted in step s6007*a* or s6009*a*, a printing direction inversion flag of Flg_Col=1 is set. If it is decided in step s6008*a* that the direction of the print image is not to be inverted, a printing direction inversion flag of Flg_Col=0 is set.

When the processing in steps s6005*b* to s6009*b* completes, the processing moves to step s6016. In step s6016, the direction of the print image is finally decided based on a combination of the printing direction inversion flag Flg_Bk decided in step s6005*a* to s6009*a* and the printing direction inversion flag Flg_Col determined in step s6005*b* to s6009*b*.

FIG. 11 is a table illustrating a method for finally determining the direction of a print image. The second row of the table has a printing direction inversion flag Flg_Bk, and the third row has a printing direction inversion flag Flg_Col, and the table has a total of four combinations including two combinations of 0 and 1 of each of the flags. The fourth row of the table has the direction of a print image finally determined for each of the combinations. In this case, only when both of Flg_Bk and Flg_Col are set to printing in the normal direction, the direction of the print image is finally determined as the normal direction. In cases other than the case, when at least one of the remaining amounts in black ink and the remaining amounts in chromatic color inks differ largely and the printing in the opposite direction is set, the direction of the print image is finally determined as the opposite direction. The reasons for such control in those cases will be described.

If Flg_Bk=0, Flg_Col=0, the differences in remaining amount of both of black and chromatic colors are equal to or lower than a predetermined amount. It may be said therefore that the current printing direction is kept. Next, if Flg_Bk=1, Flg_Col=1, the differences in remaining amount of both of black and chromatic colors are higher than the predetermined amount, and the remaining amounts are uneven. Inverting the current direction can improve the uneven state of inks in the right and left ink tanks for control toward reduction of the differences in remaining amount. If Flg_Bk=0, Flg_Col=1, the difference in remaining amount between the black inks is equal to or lower than the predetermined amount, and the remaining amounts are even. The difference in remaining amount of the chromatic color inks is higher than the predetermined amount, and the remaining amounts are uneven. Inverting the current direction can improve the uneven state of the chromatic color inks for control toward reduction of the differences in remaining amount. Because the difference in remaining amount between black inks is small and because the remaining amounts are even, there is a low possibility that inverting the current direction causes an uneven state. If Flg_Bk=1, Flg_Col=0, the differences in remaining amount of chromatic color inks are equal to or lower than the predetermined amount, and the remaining amounts are even. The difference in remaining amount of the black inks is higher than the predetermined amount, and the remaining amounts are uneven. Inverting the current printing direction can improve the uneven state of the black inks for control toward reduction of the differences in remaining amount. Because the difference in remaining amount between chromatic color inks is small and because the remaining amounts are even, there is a low possibility that inverting the current printing direction causes an uneven state.

Because the processing in step s6010 to steps 6013*a* and s6013*b* is the same as the processing in step s5009 to steps s5012*a* and s5012*b*, any repetitive descriptions will be omitted. Next, in step s6014*a*, based on the Dot data quantized for the print head 101L, the Dot count is obtained for accumulation processing by using the following calculation formula.

$$Dot_LK+=Count_LK$$

$$Dot_LC+=Count_LC$$

$$Dot_LM+=Count_LM$$

$$Dot_LY+=Count_LY$$

Here, Count_LK, Count_LC, Count_LM, and Count_LY are printing Dot counts for inks of the respective colors in the print head 101L.

In step s6014*b*, based on the Dot data quantized for the print head 101R, the Dot count is measured for accumulation processing by using the following calculation formula.

$$Dot_RK+=Count_RK$$

$$Dot_RC+=Count_RC$$

$$Dot_RM+=Count_RM$$

$$Dot_RY+=Count_RY$$

Here, Count_RK, Count_RC, Count_RM, and Count_RY are printing Dot counts of inks of the respective colors in the print head 101R.

In step s6015, whether all pixels of image data to be printed have been completely processed is decided. If the decision results in Yes, this flow ends. The Dot_LK, Dot_LC, Dot_LM, and Dot_LY information and Dot_RK, Dot_RC, Dot_RM, and Dot_RY information cumulatively calculated up to this point may be stored in the ROM 313 and are to be used in response to an instruction to print the next document. If the decision results in No in step s6015, the processing returns to step s6010 where the remaining part of the document is processed. The processing in step s6010 to step s6015 is then repeated to the last pixel.

The consumed amounts of the ink in each of the print head 101L and the print head 101R are added for each color to estimate the remaining amount of the ink, as described above. In a case where at least one ink tank has a significantly different remaining amount from others and the remaining amounts in the ink tanks are uneven, control is performed to invert the direction of the subsequent printing so that the consumption rates of black ink and chromatic color inks in the print heads can get close to reduce the difference in remaining amounts therebetween. This control can increase the printable amount using the ink tanks corresponding to the print head 101L and the print head 101R. This embodiment is particularly highly advantageous in a configuration in which an ink tank for black ink and at least one of ink tanks for chromatic color inks are integrated among the ink tanks corresponding to the right and left print heads or a configuration in which they are to be replaced together.

It has been described that, according to this embodiment, the least remaining ink is identified in each of the right and left print heads among chromatic color inks of three CMY colors corresponding to the right and left print heads, and that the remaining amounts of the identified inks are compared to determine whether the direction of a print image is to be inverted. An embodiment of the present disclosure is not limited to such an example. The difference in remaining amount of inks between the right and left print heads may be decided for each ink color. If the difference in remaining amount for at least one color is larger than a predetermined amount, inverting the printing direction may be determined.

Third Embodiment

According to the first and second embodiments, print data are actually analyzed to obtain a Dot count so that the remaining amounts can be estimated from consumptions of inks, and the printing direction can be controlled based on the estimation result. According to a third embodiment, the printing direction may be periodically controlled, without the analysis of print data and addition of consumptions of inks, so that the printable amount using equipped ink tanks can be increased.

Figure 12:
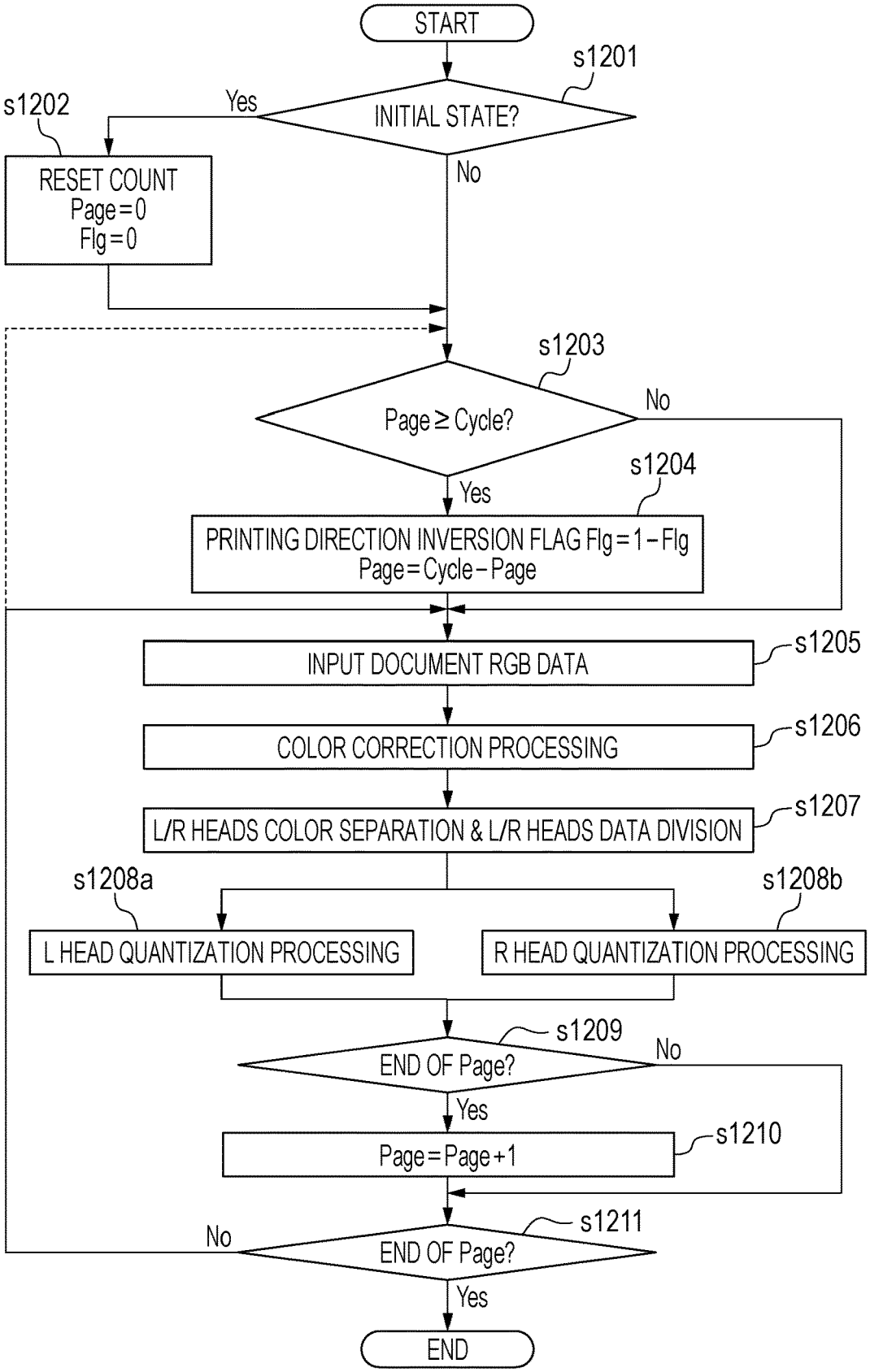
FIG. 12 is a processing flowchart according to a third embodiment according to one or more aspects of the present disclosure.

FIG. 12 is a flowchart according to one or more aspects of the present disclosure. The printing flow starts from step s1201 where whether the printer has an initial state, that is, whether the printer is new is determined. If it is determined that the printer has an initial state, the processing moves to step s1202 where "Page" indicating the number of printed pages is reset. According to this embodiment, "Page" is set to "0" here. A printing direction Flg is set to the normal direction (=0), and the processing moves to step s1203. If it is determined in step s1201 that the printer does not have an initial state, the number of printed pages up to the current point are continuously used. Thus, the processing directly moves to step s1203.

In step s1203, whether "Page" indicating the accumulated count of printed pages is equal to or higher than "Cycle" representing a reference value being a control period is decided. If the decision results in Yes, that is, if the count value is equal to or higher than the reference value, the processing moves to step s1204. In step s1204, the printing direction is inverted based on the following formula.

$$Flg=1-Flg$$

If Flg=1 (opposite direction) based on the formula, Flg=0 (normal direction). If Flg=0 (normal direction), Flg=1 (opposite direction). This inverts the direction of the print image. The "Page" representing the number of printed pages is updated with the value of "Cycle-Page". This is performed so that the numbers of printed pages are equal in the normal direction and the opposite direction. According to the method of this flow, documents included in a job have an identical direction without changing the direction within the job. This may cause the count value of "Page" to exceed "Cycle" representing a reference value when the last job ends. In this case, possibly, the degree of unevenness of the ink tanks may increase between the right and left print heads, increasing the difference between the remaining amounts therein. Therefore, the number of sheets to be printed in the inverted direction needs to be higher than the Cycle. It is assumed here that Cycle=100 and Page=105 when the processing moves to step S1203, for example. In this case, in order to set "page 105" as a page number to be printed after the printing direction is inverted, "Page" representing the count value of the number of printed sheets is updated with "Cycle−Page". Here, Cycle−Page=100−105=−5, and the count value is updated to a negative value. The number of printed pages for satisfying "Page>=Cycle" next is 105 pages so that the number of printed pages can be equal in the normal direction and the opposite direction. After the value of Page is updated, the processing moves to step s1205. If the decision results in No in step s1203, that is, if the count value is lower than the reference value, the processing directly moves to step s1205.

The processing in step s1205 to s1211 is actually performed in the flow. Because the processing in step s1205 to steps s1208*a* and s1208*b* is the same as the processing in step s6010 to steps s6013*a* and s6013*b* according to the second embodiment, any repetitive descriptions will be omitted.

After the processing in steps s1208*a* and s1208*b* is performed, the processing moves to step s1209 where the processing for the Page competes is decided. If the decision results in Yes, the processing moves to step s1210 where 1 is added to "Page" indicating the number of printed pages. The processing then moves to step s1211. If the decision results in No in step s1209, the processing directly moves to step s1211.

In step s1211, whether printing on the document has completed is decided. If the decision results in Yes, the printing flow ends and stands by for the next printing. If the decision results in No in step s1211, the processing returns to step s1205 where the printing processing is continued again.

The count of the number of Pages increments while the processing in step s1205 to step s1211 is being repeated, and when it is equal to or higher than a target number of pages or "Cycle", the inverted printing direction is applied from the next job.

Counting the number of printed pages and periodically changing the printing direction can average the consumptions of inks in the right and left print heads from a macro viewpoint and can increase the printable amount using the ink tanks equipped in the right and left print heads. In a case where the printing direction is to be changed job by job, the determination for the next change may be performed in consideration of the number of printed sheets exceeding a preset number of pages. This can average the consumptions of the right and left print heads and can increase the accuracy for reducing the difference between ink remaining amounts within the tanks.

Variation Example of Third Embodiment

According to the third embodiment, the printing direction is not changed while a job is being processed and whether the printing direction is to be changed or not is determined before the next job. According to a variation example, in a case where one job includes a plurality of pages, the printing direction may be changed at predetermined periods.

According to this variation example, referring to the flowchart in FIG. 12, if the decision results in No in step s1211, the processing returns to step s1203 as indicated by a broken line in FIG. 12, without returning to step s1205. For example, if Cycle=10 is set, the direction of the print image may be rotated by 180 degrees every 10 pages of a print document. If Cycle=1 is set, the direction is rotated every one page.

Changing the printing direction at periods of a predetermined number of pages can average the consumptions of inks in the right and left print heads and can increase the accuracy for reducing the difference between the ink remaining amounts within the tanks therein. Simple processing is performed according to the third embodiment and the variation example thereof, which is applicable for use cases in which a predetermined number of sheets are to be repeatedly printed. For example, it may be applicable to a use case where, after a predetermined number of front sides are printed, the equal number of back sides are printed or to a use case where such printing a front side and a back side is repeated.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the aforementioned embodiments, the processes illustrated in FIG. 5 and FIGS. 6A and 6B, that is processing for obtaining information regarding the remaining amounts of ink and determining the printing direction based on the information is performed in the printer 100. These processes may be performed in the host PC 300 or may be allocated to the host PC 300 and the printer 100.

The printer 100 may hold values of counts of Dots ejected from the print head 101L and the print head 101R. A replaceable ink tank or a print head integrated to an ink tank may hold such a count value. In a case where a replaceable ink tank or a print head holds a count value, the deciding of whether the print head is new or not in steps s5001*a* and s5001*b* in FIG. 5, steps s6001*a* and s6001*b* in FIG. 6A, and step s1201 in FIG. 12 may be omitted. In a case where an ink tank or a print head integrated to an ink tank holds a count value and when the head while being used is shifted to a main body of another different printing apparatus, the effects of the present disclosure can be obtained.

The direction of a print image according to the aforementioned embodiments may be determined printing job by printing job or every predetermined number of pages. In a case where the direction of a print image is determined printing job by printing job, the direction is not inverted while one printing job is being processed but the same direction is kept. In a case where the direction of a print image is determined page by page, printing can highly possibly be continued even when ink is used up in one of the tanks.

Having described the case where, according to the aforementioned embodiments, the right and left print heads 101L and the print head 101R overlappingly perform printing on the region A4, the region A4 may have a width of 0. In other words, the printing region A1 of the print head 101L does not overlap the printing region A2 of the print head 101R. Printing may be allocated therebetween without overlapping can provide the effect for solving uneven ink remaining amounts.

Having described that, according to the aforementioned embodiments, a printing Dot count is obtained based on quantized binary print data to estimate a target ink remaining amount, the scheme for obtaining the remaining amount is not limited thereto. For example, a sensor may be used to detect such a remaining amount, or any other measures may be applied if the ink remaining amount within an ink tank can be estimated.

In a configuration in which tanks of inks of a plurality of colors such as black, cyan, magenta, and yellow are integrated, the present disclosure can provide a higher effect. The tanks of inks may be provided separately, or some of a plurality of ink tanks may be integrally provided. According to the aforementioned embodiments, print head examples are applied which have a print chip provided in a printing element is detachable integrally with the ink tank. In this case, when ink of one of colors in the integrated ink tanks is used up, not only the ink tank but also the whole print head including the print chip is to be replaced. Therefore, the present disclosure may not provide a further significant effect. According to the present disclosure, ink tanks and printing chips may be provided separately, and an ink tank may only be removed for replacement from the printing apparatus. In this case, in step s5001*a* and step s5001*b*, for example, whether the ink tank is new or not or whether the ink tank is full of ink or not may be decided. The right and left print heads may be provided separately or integrally, or the right and left chips may be provided integrally. In this case, the printing elements with inks of an identical color for performing printing on the region A1 and the region A2 may be separated by a predetermined distance as indicated by the position X1 and the position X2 in the X direction in FIG. 2. The predetermined distance here may be any distance if it enables to divide and allocate a region in the X direction on a recording medium to the right and left print heads and may be determined based on the configuration of the printing apparatus and the size of the recording medium.

The aforementioned embodiments provide a higher effect in a case where an image to be printed on a recording medium with a large difference in ink amounts between the right and left sides of the medium. Printing a text document may cause a large difference between ink amounts on the right and left side. Therefore, whether a print image is a text document or not may be decided by the CPU 301, and, only if so, the control according to the aforementioned embodiments may be executed. Here, whether image data corresponding to the image is text data or not may be decided to decide whether the print image is such a document or not.

Because of this configuration, in a printing apparatus which has a plurality of printing units and which is configured to divide and allocate a print target region in a scanning direction to the printing units, the printable amount using ink tanks corresponding to the printing units can be increased.

While the present disclosure has been described with reference to exemplary embodiments, the scope of the following claims is to be accorded with the broadest interpretation so as to encompass all such modifications and equivalent structures and functions.

This application claims the benefit of Japanese Patent Application No. 2016-220858 filed Nov. 11, 2016, which is hereby incorporated by reference herein in its entirety.

What is claimed is:

1. A printing apparatus comprising:

a first printing unit having printing elements for ejecting ink stored in a first tank, the first printing unit being configured to perform printing on a first region on a recording medium conveyed in a conveying direction;

a second printing unit having printing elements for ejecting ink stored in a second tank, the second printing unit being disposed separately from the first printing unit by a predetermined distance in a scanning direction intersecting with the conveying direction, the second printing unit being configured to perform printing on a second region on the recording medium, wherein the second region includes a region adjacent to the first region in the scanning direction;

an obtaining unit configured to obtain first information regarding a remaining amount of the ink in the first tank and second information regarding a remaining amount of the ink in the second tank;

a determining unit configured to determine an execution mode for printing an image on the conveyed recording medium into a first mode or a second mode based on the first information and the second information, wherein the first mode is a mode in which a top part of the image is printed on a leading edge side of the conveyed print medium, wherein the second mode is a mode in which a top part of the image is printed on a trailing edge side of the conveyed print medium, and wherein the image printed in the first mode and the image printed in the second mode are in a relationship of being rotated by 180 degrees from each other on a face of the conveyed recording medium; and a control unit configured to control printing to be performed on the image based on the determined execution mode.

2. The printing apparatus according to claim 1, wherein the determining unit determines the execution mode based on a difference between a value indicated by the first information and a value indicated by the second information.

3. The printing apparatus according to claim 2, wherein, in a case where the difference is equal to or lower than a predetermined amount, the determining unit determines the first mode as the execution mode and, in a case where the difference is higher than the predetermined amount, the determining unit determines the second mode as the execution mode.

4. The printing apparatus according to claim 3, wherein, in a case where a job includes a document having a plurality of pages, the control unit controls such that all of the plurality of pages of the document are to be printed in the determined execution mode.

5. The printing apparatus according to claim 2, wherein the first tank and the second tank store achromatic ink, and the first information and the second information represent remaining amounts of the achromatic ink.

6. The printing apparatus according to claim 5, wherein the first tank and the second tank further store chromatic ink.

7. The printing apparatus according to claim 6, wherein the chromatic ink is of at least one color of cyan, magenta, and yellow.

8. The printing apparatus according to claim 6, wherein the obtaining unit further obtains third information regarding a remaining amount of the chromatic ink in the first tank and fourth information regarding a remaining amount of the chromatic ink in the second tank; and wherein the determining unit determines the execution mode based on a difference between a value indicated by the third information and value indicated by the fourth information.

9. The printing apparatus according to claim 8, wherein the determining unit calculates a difference between the remaining amounts for each ink color based on the first information, the second information, the third information and the fourth information, and determines the execution mode based on a result of the calculation.

10. The printing apparatus according to claim 6, wherein each of the first tank and the second tank has inks of a plurality of colors as the chromatic ink; and wherein the determining unit determines the execution mode based on (i) a difference between the value indicated by the first information and the value indicated by the second information and (ii) a difference between a value indicating a remaining amount of the least remaining ink of the plurality of chromatic inks in the first tank and a value indicating a remaining amount of the least remaining ink of the plurality of chromatic inks in the second tank.

11. The printing apparatus according to claim 2, wherein the determining unit (i) determines the execution mode into the first or second mode that is different from a mode that was determined last time in a case where a difference between a value indicated by the first information and a value indicated by the second information is higher than a predetermined threshold value and (ii) determines the execution mode into the first or second mode that is the same as the mode that was determined last time in a case where the difference between the value indicated by the first information and the value indicated by the second information is lower than the predetermined threshold value.

12. The printing apparatus according to claim 1, wherein the determining unit determines the execution mode based on a ratio between a value indicated by the first information and a value indicated by the second information.

13. The printing apparatus according to claim 12, wherein the determining unit (i) determines the execution mode into the first or second mode that is different from a mode that was determined last time in a case where a ratio of a value indicated by the second information to a value indicated by the first information is higher than a predetermined threshold value, (ii) determines the execution mode into the first or second mode that is different from the mode that was determined last time in a case where the ratio of the value indicated by the first information to the value indicated by the second information is higher than the predetermined threshold value, and (iii) determines the execution mode into the first or second mode that is the same as the mode that was determined last time in a case where the ratio of the value indicated by the second information to the value indicated by the first information is lower than the predetermined threshold value and the ratio of the value indicated by the first information to the value indicated by the second information is lower than the predetermined threshold value.

14. The printing apparatus according to claim 1, further comprising a unit for receiving a job input for instructing to print an image, wherein, in response to the input of the job, the obtaining unit obtains the first information and the second information.

15. The printing apparatus according to claim 1, wherein the first information relates to the number of times of ejection of ink from the first printing unit, and the second information relates to the number of times of ejection of ink from the second printing unit.

16. The printing apparatus according to claim 1, wherein the first region is printed by using the first printing unit without using the second printing unit, and the second region is printed by using the second printing unit without using the first printing unit.

17. The printing apparatus according to claim 1, wherein the first region includes a region to be printed by using the first printing unit without using the second printing unit and an overlapped region to be printed by using both of the first printing unit and the second printing unit, and the second region includes the region, adjacent to the first region, to be printed by using the second printing unit without using the first printing unit and the overlapped region.

18. The printing apparatus according to claim 1, wherein the first tank is detachable integrally with a chip having the printing elements in the first printing unit, and the second tank is detachable integrally with a chip having the printing elements in the second printing unit.

19. The printing apparatus according to claim 18, wherein the chip having the printing elements in the first printing unit and the chip having the printing elements in the second printing unit are provided separately.

20. The printing apparatus according to claim 1, wherein the first tank is detachable and is provided separately from a chip having the printing elements in the first printing unit, and the second tank is detachable and is provided separately from a chip having the printing elements in the second printing unit.

21. The printing apparatus according to claim 1, further comprising a deciding unit configured to decide whether image data corresponding to a print image is text data or not, and the determining unit (i) determines the execution mode based on the first information and the second information in a case where the deciding unit decides that the image data is text data, and (ii) determines the execution mode into the first or second mode that is the same as a mode that was determined last time, independently from the first information and the second information in a case where the deciding unit decides that the image data is not text data.

22. A printing method comprising:

performing printing on a first region on a recording medium conveyed in a conveying direction by using a first printing unit having printing elements for ejecting ink stored in a first tank;

performing printing on a second region on the recording medium by using a second printing unit having printing elements for ejecting ink stored in a second tank, the second printing unit being disposed separately from the first printing unit by a predetermined distance in the scanning direction intersecting with the conveying direction, wherein the second region includes a region adjacent to the first region in a scanning direction, obtaining first information regarding a remaining amount of the ink in the first tank and second information regarding a remaining amount of the ink in the second tank;

determining an execution mode for printing an image on the conveyed recording medium into a first mode or a second mode, based on the first information and the second information, wherein the first mode is a mode in which a top part of the image is printed on a leading edge side of the conveyed print medium, wherein the second mode is a mode in which a top part of the image is printed on a trailing edge side of the conveyed print medium, and wherein the image printed in the first mode and the image printed in the second mode are in a relationship of being rotated by 180 degrees from each other on a face of the conveyed recording medium; and printing the image based on the determined execution mode.

* * * * *